US011240584B2

(12) United States Patent
Lalvani

(10) Patent No.: US 11,240,584 B2
(45) Date of Patent: Feb. 1, 2022

(54) EARPHONE SYSTEMS

(71) Applicant: Binatone Electronics International Ltd., Hong Kong (CN)

(72) Inventor: Dino Lalvani, Hong Kong (CN)

(73) Assignee: Binatone Electronics International Ltd., Sheun Wan (HK)

( * ) Notice: Subject to any disclaimer, the term of this patent is extended or adjusted under 35 U.S.C. 154(b) by 0 days.

(21) Appl. No.: 16/815,608

(22) Filed: Mar. 11, 2020

(65) Prior Publication Data

US 2020/0304900 A1 Sep. 24, 2020

(30) Foreign Application Priority Data

Mar. 18, 2019 (GB) ..... 1903660
Apr. 10, 2019 (GB) ..... 1905110
Sep. 6, 2019 (GB) ..... 1912896

(51) Int. Cl.
*H04R 1/10* (2006.01)
*H01R 13/24* (2006.01)
*H01R 13/62* (2006.01)

(52) U.S. Cl.
CPC ..... *H04R 1/1033* (2013.01); *H01R 13/24* (2013.01); *H01R 13/6205* (2013.01);
(Continued)

(58) Field of Classification Search
CPC combination set(s) only.
See application file for complete search history.

(56) References Cited

U.S. PATENT DOCUMENTS 9,635,448 B2 * 4/2017 Monahan ..... H04R 5/033
10,397,689 B2 8/2019 Tang
(Continued)

FOREIGN PATENT DOCUMENTS

CN 204795530 U 11/2015
CN 105263079 A 1/2016
(Continued)

OTHER PUBLICATIONS

Search Report for corresponding GB1905110.1, dated Jun. 12, 2019, 4 pages.
(Continued)

*Primary Examiner* — Duc Nguyen
*Assistant Examiner* — Assad Mohammed
(74) *Attorney, Agent, or Firm* — Patterson Intellectual Property Law, PC; Emily A. Shouse

(57) ABSTRACT

An earphone system (10) includes a first ear bud (12) having wireless communications circuitry, a second ear bud (14) having wireless communications circuitry and first electric cabling (16) having a first end provided with a first electrical connector element (18) releasably connectable with the first ear bud, a second end provided with a second electrical connector element (20) releasably connectable with the second ear bud and a third electrical connector element (22) disposed intermediate the first and second ends. The earphone system (10) has second electric cabling (24) having a first end provided with a fourth electrical connector element (26) releasably connectable with the third electrical connector element and a second end provided with a fifth electrical connector element (28) connectable an output connector element of an electronic device to receive an audio signal from the electronic device.

18 Claims, 11 Drawing Sheets

(52) U.S. Cl.
CPC ..... *H04R 1/1016* (2013.01); *H04R 1/1025* (2013.01); *H04R 2420/07* (2013.01); *H04R 2420/09* (2013.01)

(56) References Cited

U.S. PATENT DOCUMENTS

| | | | | |
|---|---|---|---|---|
| 2011/0103609 | A1* | 5/2011 | Pelland | H04M 1/0254 381/74 |
| 2013/0267120 | A1* | 10/2013 | Rothkopf | H01R 13/6683 439/620.21 |
| 2014/0037102 | A1* | 2/2014 | Alanis | H04R 1/1033 381/74 |
| 2015/0030053 | A1* | 1/2015 | Akervall | G01K 7/023 374/179 |
| 2015/0312668 | A1* | 10/2015 | White | H04R 1/1033 381/374 |
| 2016/0064854 | A1* | 3/2016 | Schooley | H01R 13/2421 439/39 |
| 2017/0093079 | A1* | 3/2017 | Wagman | B65D 25/02 |
| 2017/0094386 | A1* | 3/2017 | Trainer | G10K 11/17857 |
| 2017/0111724 | A1* | 4/2017 | Toner | H04R 1/1041 |
| 2017/0134845 | A1* | 5/2017 | Milam | H04R 1/1033 |
| 2017/0195771 | A1* | 7/2017 | Hung | H04R 1/10 |
| 2017/0295421 | A1 | 10/2017 | Hung | |
| 2020/0029149 | A1* | 1/2020 | Nielsen | H02J 7/025 |
| 2020/0266640 | A1* | 8/2020 | Valenzuela | H02J 7/0044 |

FOREIGN PATENT DOCUMENTS

| | | | |
|---|---|---|---|
| CN | 205249440 | U | 5/2016 |
| CN | 206136196 | U | 4/2017 |
| CN | 107786917 | A | 3/2018 |
| CN | 110418239 | A | 11/2019 |
| CN | 209861123 | U | 12/2019 |
| EP | 3393137 | A1 | 10/2018 |

OTHER PUBLICATIONS

Search Report for corresponding GB1912896.6, dated Feb. 19, 2020, 5 pages.

* cited by examiner

EARPHONE SYSTEMS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: GB 1903660.7 filed Mar. 18, 2019; GB 1905110.1 filed Apr. 10, 2019; and GB 1912896.6 filed Sep. 6, 2019.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to earphone systems.

Users of portable electronic devices such as laptop computers, tablets and mobile (cellular) telephones often listen to audio content using an earphone system. An earphone system may comprise wireless ear buds that are able to communicate with a portable electronic device without the need of a physical connection to the portable electronic device. Wireless ear buds may connect to the portable electronic device by means of a wireless protocol such as Bluetooth®. Earphone systems utilizing ear buds may include a microphone and speakers to allow the earphone system to handle telephone calls and media playback.

BRIEF SUMMARY OF THE INVENTION

The invention provides an earphone system comprising:

a first ear bud having wireless communications circuitry and an electrical connector element;

a second ear bud having wireless communications circuitry and an electrical connector element;

a first electric cabling having a first end provided with a first electrical connector element releasably connectable with said electrical connector element of said first ear bud, a second end provided with a second electrical connector element releasably connectable with said electrical connector element of said second ear bud and a third electrical connector element disposed intermediate said first and second ends of the first electric cabling; and second electric cabling having a first end provided with a fourth electrical connector element releasably connectable with said third electrical connector element and a second end provided with a fifth electrical connector element connectable with an output connector element of an electronic device to receive an audio signal from said electronic device.

The invention also includes an electronic system comprising:

an earphone system comprising:

a first ear bud having wireless communications circuitry and an electrical connector element;

a second ear bud having wireless communications circuitry and an electrical connector element;

a first electric cabling having a first end provided with a first electrical connector element releasably connectable with said electrical connector element of said first ear bud, a second end provided with a second electrical connector element releasably connectable with said electrical connector element of said second ear bud and a third electrical connector element disposed intermediate said first and second ends of the first electric cabling; and second electric cabling having a first end provided with a fourth electrical connector element releasably connectable with said third electrical connector element and a second end provided with a fifth electrical connector element connectable with an output connector element of an electronic device to receive an audio signal from said electronic device, a said electronic device, wherein said electronic device comprises a said output connector element and wireless communications circuitry configured to communicate the said wireless communications circuity of at least one of said first and second ear buds.

The invention also includes a storage case and an earphone system, wherein:

said earphone system comprises:

a first ear bud having wireless communications circuitry and an electrical connector element;

a second ear bud having wireless communications circuitry and an electrical connector element;

a first electric cabling having a first end provided with a first electrical connector element releasably connectable with said electrical connector element of said first ear bud, a second end provided with a second electrical connector element releasably connectable with said electrical connector element of said second ear bud and a third electrical connector element disposed intermediate said first and second ends of the first electric cabling; and second electric cabling having a first end provided with a fourth electrical connector element releasably connectable with said third electrical connector element and a second end provided with a fifth electrical connector element connectable with an output connector element of an electronic device to receive an audio signal from said electronic device; and said storage case comprising a case body having:

first recessing configured to receive said first and second ear buds;

a first cable track extending about said case to receive first electric cabling;

third recessing configured to receive said third electrical connector element;

fourth recessing configured to receive said fourth electrical connector element;

fifth recessing configured to receive said fifth electrical connector element; and a second cable track extending about said case to receive second electric cabling.

The invention also includes an earphone system comprising:

a first ear bud having wireless communications circuitry and an electrical connector element;

a second ear bud having wireless communications circuitry and an electrical connector element;

a first electric cabling having a first end provided with a first connector element releasably connectable with said electrical connector element of said first ear bud and a second end provided with a second electrical connector element releasably connectable with said electrical connector element of said second ear bud; and second electric cabling having a first end provided with a third electrical connector element releasably connectable with said electrical connector element of said first ear bud, a fourth electrical connector element releasably connectable with said electrical connector element of said second ear bud and a third end provided with a fifth electrical connector element connectable with an output connector element of an electronic device to receive an audio signal from said electronic device.

BRIEF DESCRIPTION OF THE SEVERAL VIEWS OF THE DRAWINGS

In order that the invention may be well understood, some examples thereof, which are given by way of example only, will now be described with reference to the drawings in which.

DETAILED DESCRIPTION OF THE INVENTION

Figure 1:
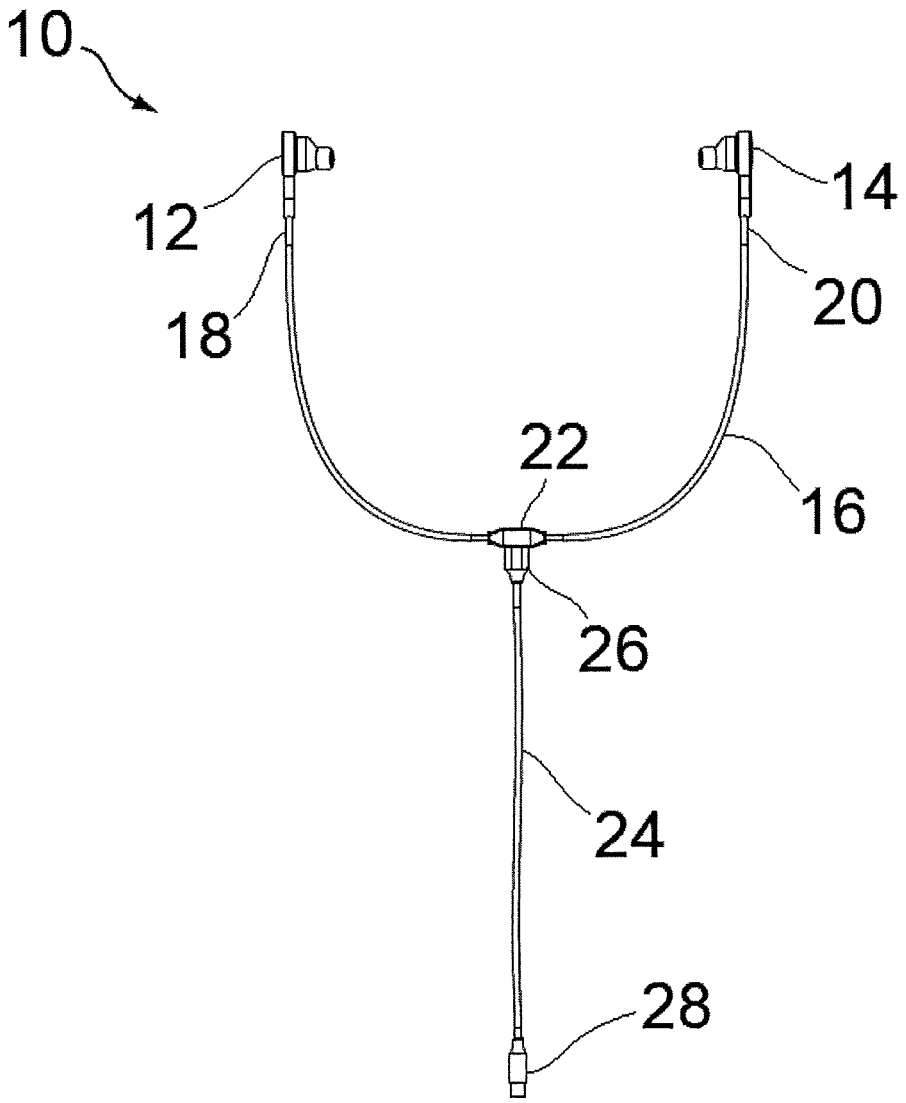
FIG. 1 shows an earphone system.

Referring to FIG. 1, an earphone system 10 may comprise a first ear bud 12 and a second ear bud 14. The earphone system 10 may further comprise first electric cabling 16 having a first end provided with a first electrical connector element 18 releasably connectable with the first ear bud 12, a second end provided with a second electrical connector element 20 releasably connectable with the second ear bud 14 and a third electrical connector element 22 disposed intermediate the first and first and second ends of the first electric cabling. The earphone system 10 may further comprise second electric cabling 24 having a first end provided with a fourth electrical connector element 26 releasably connectable with the third electrical connector element 22 and a second end provided with a fifth electrical connector element 28 connectable an output connector element 30 (FIG. 2) of an electronic device 32 to receive an audio signal from the electronic device.

Figure 2:
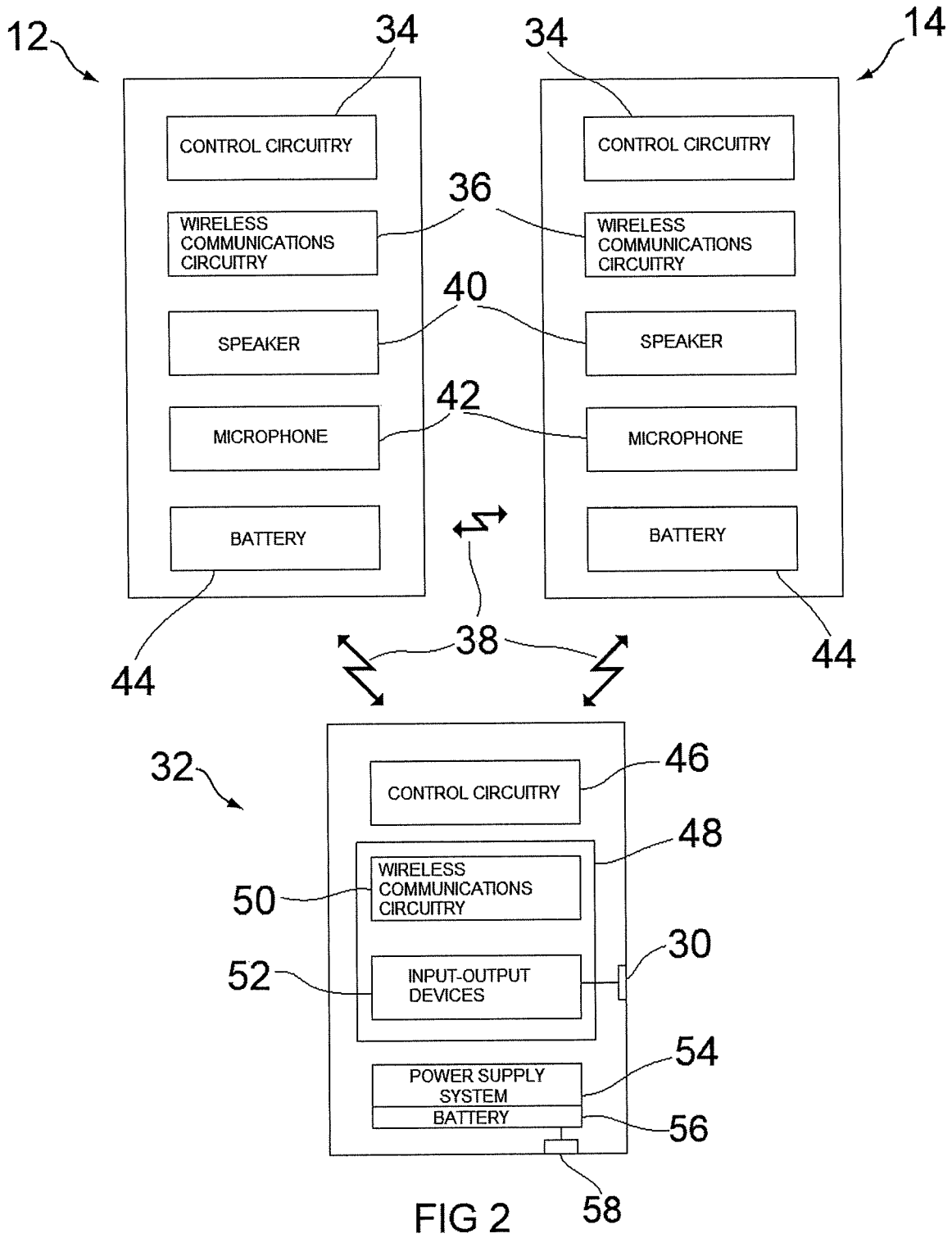
FIG. 2 is a schematic representation of ear buds of the earphone system of FIG. 1 and an electronic device wirelessly connected with the ear buds.

Referring to FIG. 2, each ear bud 12, 14 may have control circuitry 34 and wireless communications circuitry 36. The control circuitry 34 may comprise storage and processing circuitry for supporting operation of ear bud. The storage circuitry may comprise non-volatile memory (for example flash memory or other electrically-programmable-read-only memory configured to form a solid-state drive) and volatile memory (for example static or dynamic random-access-memory). Processing circuitry in the control circuitry 34 may be used to control the operation of the ear bud. The processing circuitry may be based on one or more microprocessors, microcontrollers, digital signal processors, baseband processors, power management units, audio chips and application specific integrated circuits. The processing circuitry may include multiple processors.

The wireless communications circuitry 36 may comprise one or more radio-frequency transceivers for supporting wireless communications over wireless links 38. The radio transceiver, or one or more of a plurality of transceivers, may be configured to transmit and receive wireless transmissions using a Bluetooth® protocol. In some examples, the ear bud 12 may be configured as a master with a transceiver that is able to receive signals from the electronic device 32 and transmit signals to both the ear bud 14 and the electronic device 32, while the ear bud 14 may be configured as a slave with just a receiver that can receive signals from the ear bud 12. In other examples, each ear bud 12, 14 may communicate separately with the electronic device via transceivers or receivers of their respective wireless communications circuitry 36.

Each ear bud 12, 14 comprises one or more speakers 40. The speakers 40 may play audio into the ears of a user. Optionally, one or each ear bud 12, 14 may be provided with a microphone 42 to collect, or gather, audio data such as the voice of a user who is making a telephone call. During operation of the ear buds 12, 14, a user may supply tap commands (e.g., double taps, triple taps, other patterns of taps, single taps, etc.) to control the operation of the ear buds. Although not shown in FIG. 2, the ear buds 12, 14 may be provided with a sensor system to detect such tap commands. The sensor system may comprise an accelerometer to detect tap commands and an optical proximity sensor or other sensor to provide data used to detect false tap detections when processing tap commands. As described below with reference to FIG. 3, one or both of the ear buds 12, 14 may be provided with a switch or button for inputting commands.

The ear buds 12, 14 may each be provided with a power source, which may comprise a rechargeable battery or power pack 44.

Still referring to FIG. 2, the electronic device 32 may be a portable electronic device such as a laptop, tablet or mobile (cellular) telephone such as a smartphone. The electronic device 32 may comprise control circuitry 46. The control circuitry 46 may include storage and processing circuitry for supporting the operation of the electronic device 32. The storage and processing circuitry may include storage such as hard disk drive storage, non-volatile memory (for example flash memory or other electrically programmable-read only memory configured to form a solid-state drive) and volatile memory (for example static or dynamic random access memory). Processing circuitry in the control circuitry 46 may be used to control the operation of the electronic device 32. The processing circuitry may be based on one or more microprocessors, microcontrollers, digital signal processors, baseband processors, power management units, audio chips, application specific integrated circuits. The processing circuitry may include multiple processors.

The electronic device 32 may have an input/output system 48. The input/output system 48 may include wireless communications circuitry 50 for supporting wireless communications with suitably equipped electronic devices, such as the as the ear buds 12, 14. Thus, the wireless communications circuitry 50 may comprise at least one transceiver configured to transmit and receive signals using a Bluetooth® protocol.

The input/output system 48 may include input/output devices 52 that may be used to input data and commands to the electronic device 32 and output data from the electronic device to one or both of external devices and a user of the electronic device. The input/output devices 52 may include buttons, joysticks, scrolling wheels, touch pads, keypads, keyboards, microphones, speakers, displays (for example a touch screen), tone generators, vibrators (for example piezoelectric vibrating components), cameras, sensors, light-emitting diodes and other status indicators. The input/output devices 52 include the output connector element 30. A user can control the operation of electronic device 32 by inputting commands through input/output devices 52 and may receive status information and other output using the output components of the input/output devices 52.

The electronic device 32 may be provided with a power supply system 54, which may comprise a battery or power pack 56. The power supply system 54 may comprise suitable conditioning and distribution circuitry to enable the distribution of suitable electrical supplies to the various components of the electronic device 32 that require electric power. with the power supply system 54 may include a suitable power input port to allow connection to a mains electricity power supply to power the electronic device or recharge the battery 56.

The control circuitry 34 of the ear buds 12, 14 and the control circuitry 46 of the electronic device 32 may be used to run software on the ear buds 12, 14 and the electronic device 32, respectively. For example, the control circuitry 34, 46 may be used to run software for coordinating operation of the ear buds 12, 14 for handshaking operations and the like. In examples in which the electronic device 32 is a mobile (cellular) telephone, the software running on control circuitry 34, 46 may be used to enable the user to make and receive telephone calls with incoming audio signals being transmitted by the wireless communications circuitry 50 of the electronic device 32 to the wireless communications circuitry 36 of one or both of the earbuds 12, 14 and audio output into the user's ears by the respective speakers 40 of the ear buds. In examples in which at least one of the ear buds 12, 14 is provided with a microphone, the user's speech or other captured sounds may be converted into suitable audio signals and transmitted by the wireless communications circuitry 36 to the wireless communications circuitry 50 of the electronic device 32 for onward transmission via a mobile (cellular) communications network.

In some examples, the ear buds 12, 14 may be used to provide stereo output. This may be obtained by configuring the ear bud 12 as a master (or primary) ear bud and the ear bud 14 as a slave (or secondary) ear bud. In that case, a wireless link 38 between the electronic device 32 and the ear bud 12 may be used to provide the ear bud with stereo content and the ear bud 12 may transmit one of the two channels of the stereo content to the ear bud 14. In other examples, one channel of the stereo content may be transmitted from the electronic device 32 to the ear bud 12, while the other channel is transmitted directly from the electronic device 32 to the ear bud 14.

Figure 3:
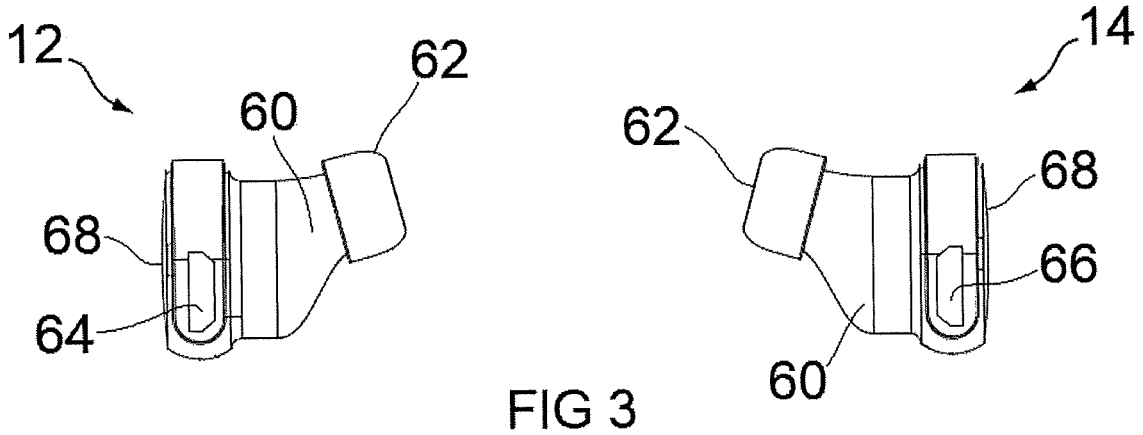
FIG. 3 is an underside view of first and second ear buds of the earphone system.
Figure 4:
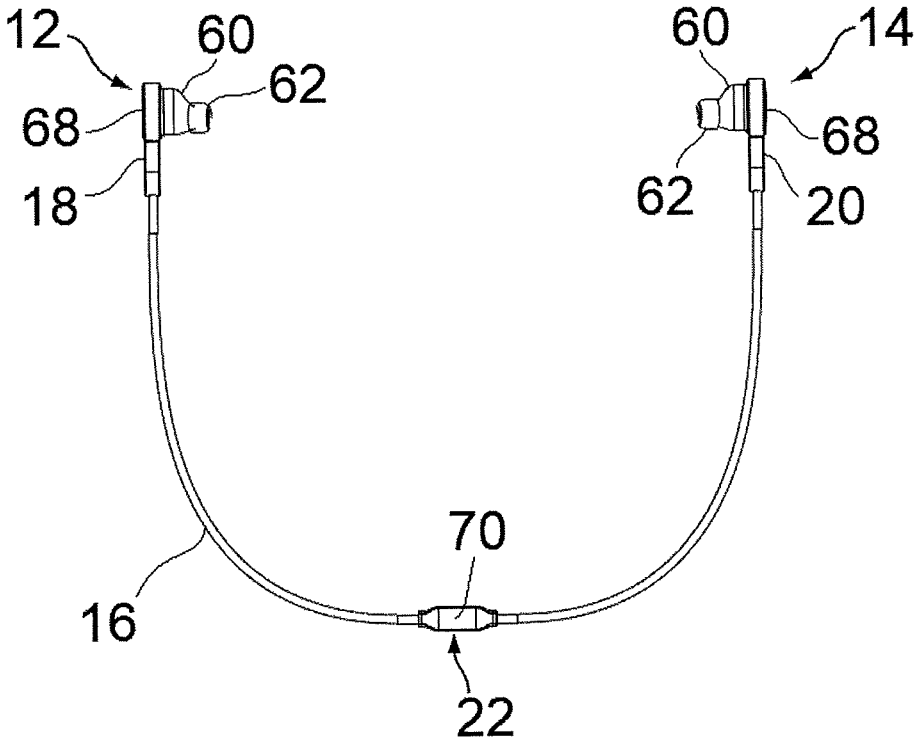
FIG. 4 shows the first and second ear buds connected with first electric cabling of the earphone system of FIG. 1.
Figure 5:
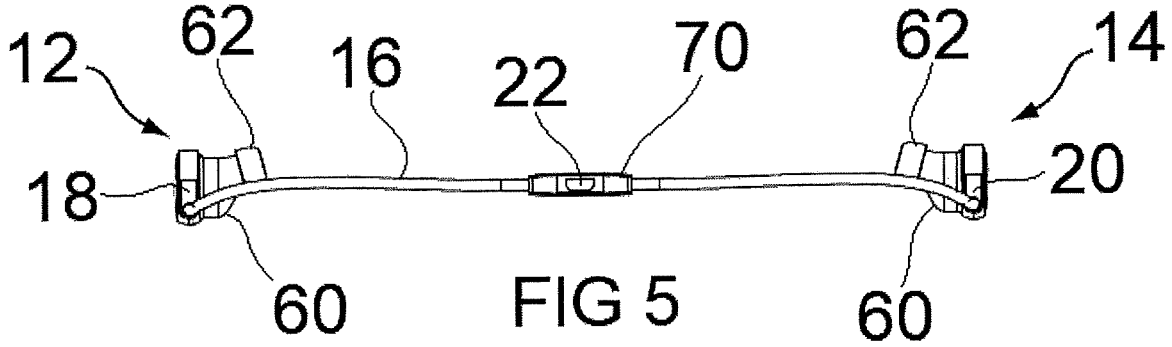
FIG. 5 is another view of the assembly of the first and second buds and first electric cabling shown in FIG. 4.

Referring to FIG. 3, each ear bud 12, 14 comprises an ear bud body 60, which houses the control circuity 34, wireless communications circuitry 36, speaker 40, battery 44 and, when provided, the microphone 42. The ear bud body 60 may be made of a relatively hard plastics material sufficiently rigid to provide the structural integrity necessary to function as a housing. The ear bud body 60 has a relatively larger outer end and tapers from the outer end towards a relative narrower inner end (the end that is fitted into a wearer's ear). The inner end of the ear bud body 60 is covered by a relatively soft cap 62. The cap 62 may, for example, be made of silicon rubber, or a similar material, that provides comfort for the wearer and can be compressed when inserted into the ear to retain the ear bud 12, 14 in the ear. A material such as silicon rubber will also provide a degree of frictional resistance to removal from the ear to assist in retaining the ear bud 12, 14 in the ear.

The ear bud body 60 of each ear bud 12, 14 is provided with an electrical connector element 64, 66 by which the first and second electrical connector elements 18, 20 are releasably connectable to the ear buds. In the illustrated example, the electrical connector elements 64, 66 are sockets and the first and second electrical connector elements 18, 20 are male parts that are insertable in the respective sockets. The first and second electrical connector elements 18, 20 and electrical connector elements 64, 66 may be the male and female parts of a micro USB connector system by means of which electrical power and audio signals may transmitted to the ear buds 12, 14 from the first electric cabling 16.

In examples in which tap commands may be used to control the ear buds 12, 14, these may be applied to the outer end faces 68 of the ear buds. In other examples, the outer end faces 68 may be configured as a rocker switch or push switch or a combination of the two that may be manipulated to input commands to the ear buds 12, 14.

The third electrical connector element 22 may be provided in a body 70 located midway between the first and second ends of the first electric cabling 16. The body 70 may be disposed midway between the first and second ends of the first electric cabling. The body 70 may be an elongate body that is relatively long in the lengthways direction of the first electric cabling 16 and relatively narrow in transverse directions perpendicular to the lengthways direction. Although the body 70 may be releasably connected with the first electric cabling 16, in the illustrated example, the body 70 is fixed to the first electric cabling such that the third electrical connector element 22 is at least substantially permanently connected to the first electric cabling. The third electrical connector element 22 may comprise a socket provided in the body 70 and the fourth connecter element 26 a male part insertable into the socket to releasably connect the second electric cabling 24 to the third electrical connector element. The third electrical connector element 22 and fourth electrical connector element 26 (FIG. 1) may be the male and female parts of a micro USB connector system by means of which electrical power and audio signals may transmitted from the second electric cabling 24 to the first electric cabling 16.

Referring again to FIG. 1, the fifth electrical connector element 28 may be a male part that is insertable in an output connector element 30 in the form of a socket provided in the electronic device 32. The fifth electrical connector element 28 and output connector element 30 may be male and female parts of a micro USB connector system by means of which an audio signal and electrical power may be transmitted from the electronic device 32 to the second electric cabling 24 for onward transmission to the ear buds 12, 14. In some examples, the fifth electrical connector element 28 may be a jack plug, for example a 3.5 mm jack plug, connectable with an output element 30 in the form of a jack socket provided in the electronic device 32. In other examples, the fifth electrical connector element 28 may be a Lightning® connector for use with an electronic device 32 manufactured by Apple Inc. In still other examples, the fifth electrical connecter element 28 may be a USB type C connector by means of which an audio signal and electrical power may be transmitted from the electronic device 32 to the second electric cabling 24 for onward transmission to the ear buds 12, 14.

Figure 8:
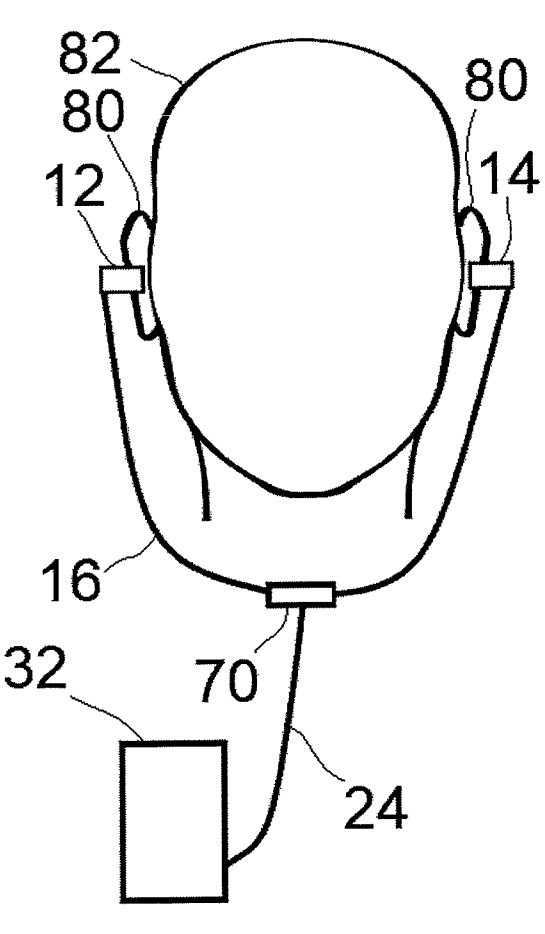
FIGS. 6 to 8 show the earphone system in various use configurations.
Figure 7:
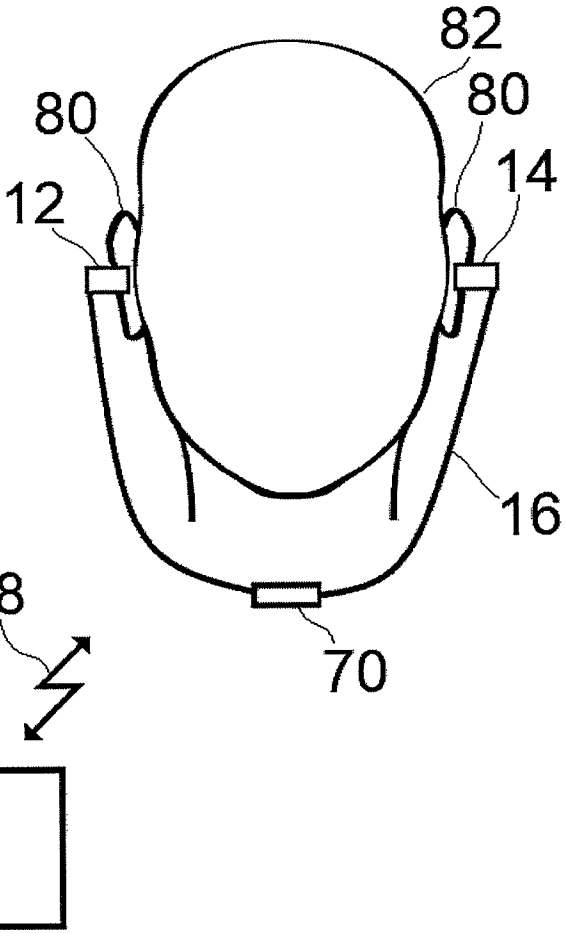
Figure 6:
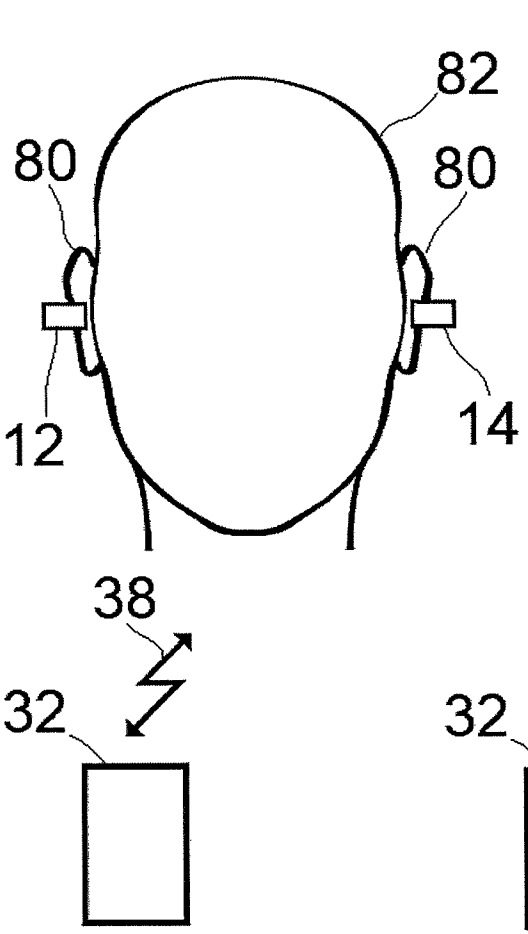

As shown in FIG. 6, the earphone system 10 may be used in a first wireless configuration with the ear buds 12, 14 inserted into respective ears 80 of the user 82. In this configuration, communication between the ear buds 12, 14 and electronic device 32 is via wireless links 38 between the wireless communications circuity 36, 50 of the ear buds 12, 14 and the electronic device 32. The wireless transmissions may be used to communicate audio signals for playback to the user via the respective speakers 40. In examples in which one or both of the ear buds 12, 14 is provided with a microphone and the electronic device 32 is a mobile (cellular) telephone, the wireless transmissions may be use to communicate audio signals representative of sounds collected by the microphone or microphones to the electronic device 32. In some instances, the user 82 may use just one of the ear buds 12, 14 when using the earphone system 10 in the first wireless configuration. Referring to FIG. 7, the earphone system 10 may be used in a second wireless configuration in which the ear buds 12, 14 are inserted in the respective ears 80 of the user 82 and the first electric cabling 16 is releasably connected to the first and second ear buds 12, 14. In this configuration, the first electric cabling is not used to transmit either an audio signal or electrical power, but provides a physical connection between the two ear buds 12, 14. As shown in FIG. 8, the earphone system 10 may be used in a hard-wired configuration in which the electronic device 32 is connected with the ear buds 12, 14 via the first and second electric cabling 16, 24.

It will be understood that the earphone system 10 may be configured so that the user, or wearer, does not have to take any action to switch between wireless and hardwired transmission of the audio signals between the ear buds 12, 14 and electronic device 32. The electronic device 32 may generate a pulse that can be detected by the control circuity 34 of one or both ear buds 12, 14. On detection of the pulse, the control circuitry 34 may shut down the wireless communications circuitry 36.

If the fifth electrical connector element 36 is configured to allow the transmission of audio signals and electrical power, for example if it is a micro USB connector, in addition to allowing a hardwired connection between the ear buds 12, 14 and an electronic device 32, the fifth electrical connector element, may when, needed be connected with an output element of a suitable transformer plug by means of which the batteries 44 carried by the ear buds may be charged with electrical power drawn from a mains electricity system.

It will be understood that the earphone system 10 provides three possible configurations, each with advantages users may prefer according to the circumstances. The configuration shown in FIG. 6 provides the freedom and simplicity of a completely wireless system. The configuration shown in FIG. 7 provides considerable freedom in that there is no physical connection between the electronic device 32 and the earphone system 10, while the first electrical cabling 16 maintains a physical connection between the two ear buds 12, 14 to provide greater security and reduce the chances of an ear bud being lost if it falls from the wearer's ear or when the ear buds are not being worn. Finally, there is the advantage of having a hard-wired connection between the ear buds 12, 14 and the electronic device 32 that allows the wireless communications circuitry 36 to be powered off to conserve battery power. It also allows the possibility of using the earphone system 10 with electronic devices that are not equipped to provide a wireless output.

In some examples, the earphone system 10 may be provided with two or more forms of second electric cabling. For example, the earphone system 10 may be provided with one form of second electric cabling with a fifth electrical connector element 28 that is a micro USB plug and another form of second electric cabling with a fifth electrical connector element that is a jack plug. Alternatively, or additionally, second electric cabling with a fifth electrical connector element comprising a USB type C plug or Lightning® plug may be provided. It will be understood that providing multiple second electric cabling with respective different fifth electrical connector elements may be used to provide an earphone system with greater flexibility allowing use with a greater number, or range, of electronic devices. Also, if the earphone system 10 were limited to a fifth electrical connector element that is a jack plug, the first and second electric cabling 16, 24 could not be used for charging purposes.

In some examples, the body 70 carrying the third electrical connector element 22 may be configured to include a battery housing to carry an auxiliary battery.

In some examples, the ear buds 12, 14 may be configured for contactless charging of their onboard batteries 44. For example, the earphone system 10 may be provided with a Qi charging mat on which the ear buds 12, 14 may be placed for wireless charging of the batteries 44. Contactless charging may be desirable when the earphone system 10 has just one form of second electric cabling 24 provided with a fifth electrical connector element 38 in the form of a jack plug or other connector that does not carry electric current for charging purposes.

In the examples described above, the third electrical connector element 22 and connector elements 64, 66 of the ear buds 12, 14 are female electrical connector elements, or sockets, and the first, second fourth and fifth electrical connector elements 18, 20 26, 28 are male electrical connector elements configured to be pushed into and engage in the connector elements 22, 64, 66. It will be understood that while this is a convenient arrangement, is not essential. For example, any of the electrical connector elements 22, 64, 66 may be male parts and the connector elements they are intended to connect with may be complementary female parts.

In the description above, the examples given of the electronic device 32 are of portable electronic devices. It will be understood that while the earphone system 10 may be particularly suitable for use with portable electronic devices, it may equally be used with static devices such as television sets, music centers, games devices and computers.

In some examples, the first electric cabling may have first and second electrical connectors as shown in the drawings, but no third electrical connector. In this case, it could only be used in the configuration shown in FIG. 7. In such examples, the second electric cabling would comprise first and second ends respectively provided with first and second electrical connectors for connection to the first and second buds and a third end provided with a third end provided with a third electrical connector releasably connectable with an electronic device in analogous fashion to the fifth electrical connectors described above.

FIGS. 9 to 13 show an earphone system 110 that is a modification of the earphone system 10. Features of the earphone system 110 that are the same as or similar to features of the earphone system 10 will be given the same reference numeral incremented by 100 and to save repetition of description, may not be described in detail again.

Figure 9:
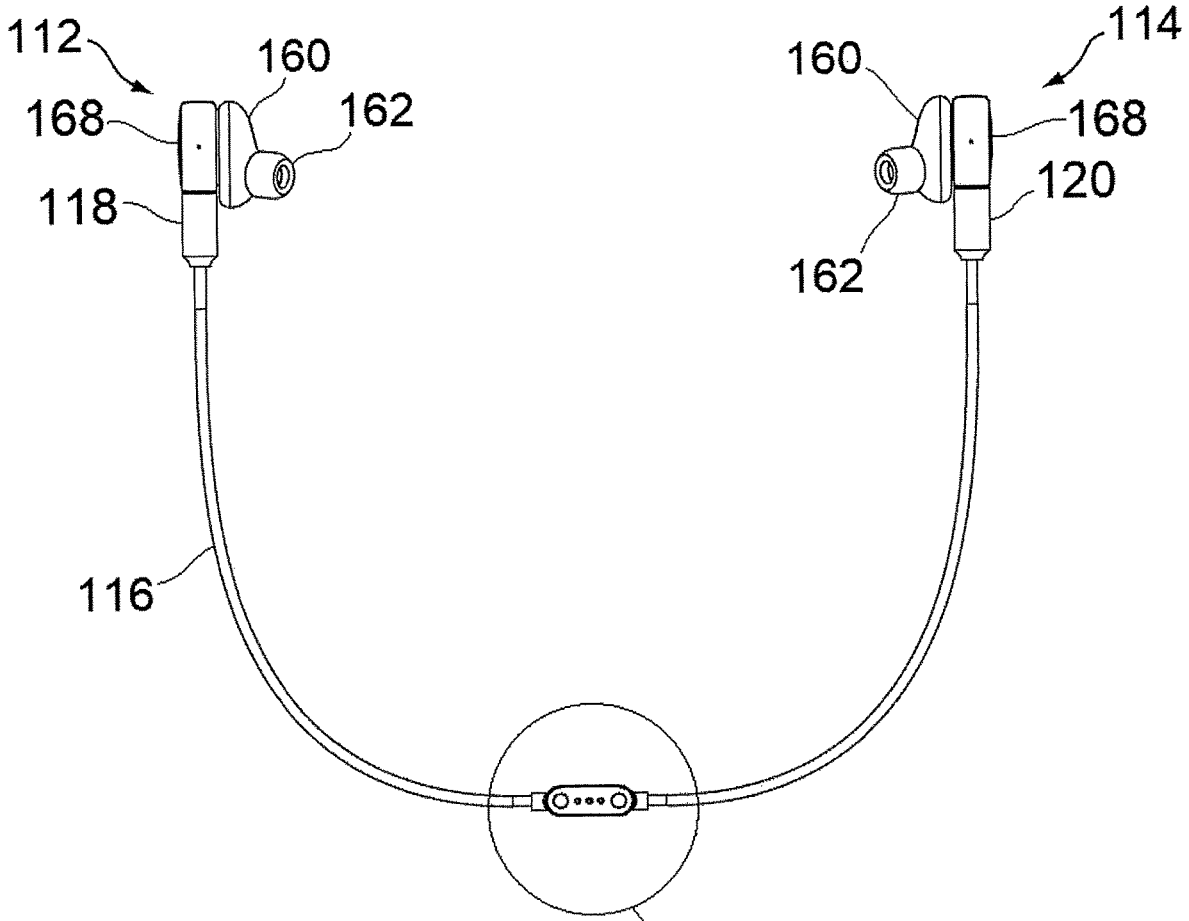
FIG. 9 is a view corresponding to FIG. 4 showing first and second ear buds and first electric cabling of another earphone system.
Figure 11:
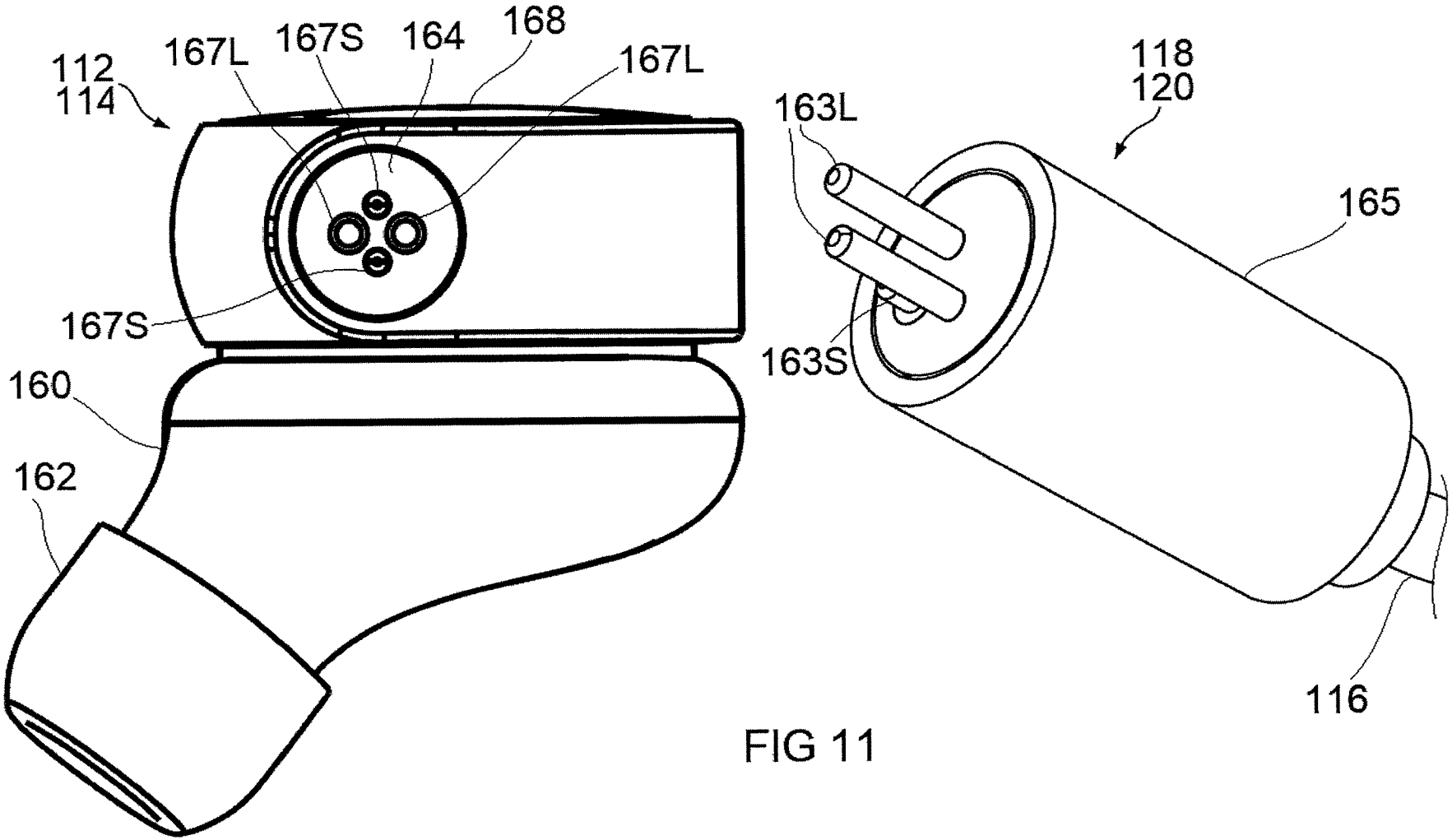
FIG. 11 shows an ear bud and first electrical connector element of first electric cabling of the earphone system of FIG. 9.

Referring to FIG. 9, the earphone system 110 comprises ear buds 112, 114 and first electric cabling 116. The ear buds 112, 114 are generally similar to the ear buds 12, 14 illustrated by FIGS. 1 to 5 and may incorporate all of the above-described features of those ear buds. As best seen in FIG. 11, the ear buds 112, 114 each comprise an ear bud body 160 that is provided at one end with a soft cap 162 for insertion in the ear. Each ear bud 112, 114 has an outer end face 168 at the end of the ear bud body 160 opposite the end that is fitted with the soft cap 162. The end face 168 may be configured to receive tap commands. Alternatively, the outer end face 168 may be configured as a rocker switch, push switch or combination of the two that may be manipulated to input commands to the ear buds 112, 114.

Still referring to FIG. 11, the ear buds 112, 114 are provided with an electrical connector element 164 and the first electric cabling 116 has first and second electrical connector elements 118, 120 configured to be releasably connectable with the electrical connector elements 164. The first and second electrical connector elements 118, 120 are electrically connected to the first and second ends of the first cabling 116. In this example, the first and second electrical connector elements 118, 120 each comprise three pins 163L, 163S carried on an end of a cylindrical body 165 and the electrical connector elements 164 each comprise four sockets 167L, 167S provided in the underside of the ear bud body 160. The three pins comprise two longer pins 163L and a shorter pin 163S. The two longer pins 163L may carry audio signals for the ear buds 112, 114 and the shorter pin 163S may be configured to carry signals output by a microphone (not shown) carried by the ear bud body 160. The four sockets comprise two sockets 167L configured to receive the longer pins 163L and two sockets 167S configured to receive the shorter pin 163S. The pins 163L and sockets 167L may have a smaller diameter than the pin 163S and sockets 167S. This configuration of the pins 163L, 163S and sockets 167L, 167S makes it easier for users to connect the first and second electrical connector elements 118, 120 with the respective electrical connector elements 164 while the ear buds 112, 114 are being worn in the ear. Since the pins 163L, 163S of the first and second electrical connector elements 118, 120 can be correctly plugged into the sockets 167L, 167S of the connector elements 164 in two different orientations that are 180° apart and the pins 163S will not fit into the sockets 167L, a user can quickly and easily plug the first and second connector elements 112, 114 into the respective ear buds 112, 114 by feel when the ear buds are being worn, even though the wearer is unable to see the connector elements 164.

Figure 10:
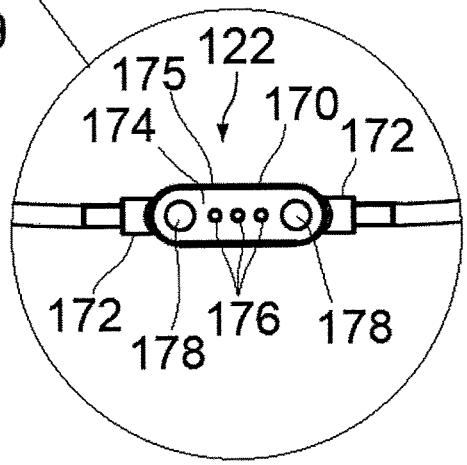
FIG. 10 is an enlargement of the circled portion of FIG. 9.

Referring to FIGS. 9 and 10, the third electrical connector element 122 may be disposed in the first electric cabling 116 midway between the first and second electrical connector elements 112, 114. The third electrical connector element 122 comprises a body 170, which may be made of a plastics material and in particular, may be a plastics molding. The body 170 may be an elongate body that is relatively long in the lengthways direction of the first electric cabling 116 and relatively narrow in directions transverse to the lengthways direction. Thus, in the direction between the opposite ends 172 of the body 170 at which the third electrical connector element 122 connects to the first electric cabling 116, the body is relatively long and in transverse directions it is relatively narrow. The body 170 defines a raised portion, or boss, 174 and a rim 175 that surrounds the boss. The third electrical connector element 122 has three electrical connectors in the form of contact pads 176 mounted in the face of the boss 174. The third connector element 122 122 also has two magnets 178 mounted in the face of the boss 174.

Figure 13:
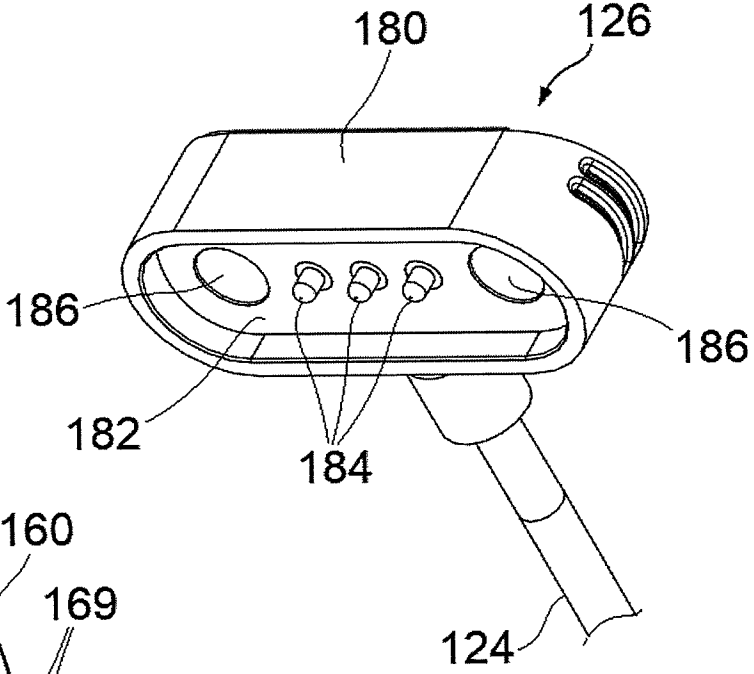
FIG. 13 is a perspective view showing the fourth electrical connector element of FIG. 12.
Figure 12:
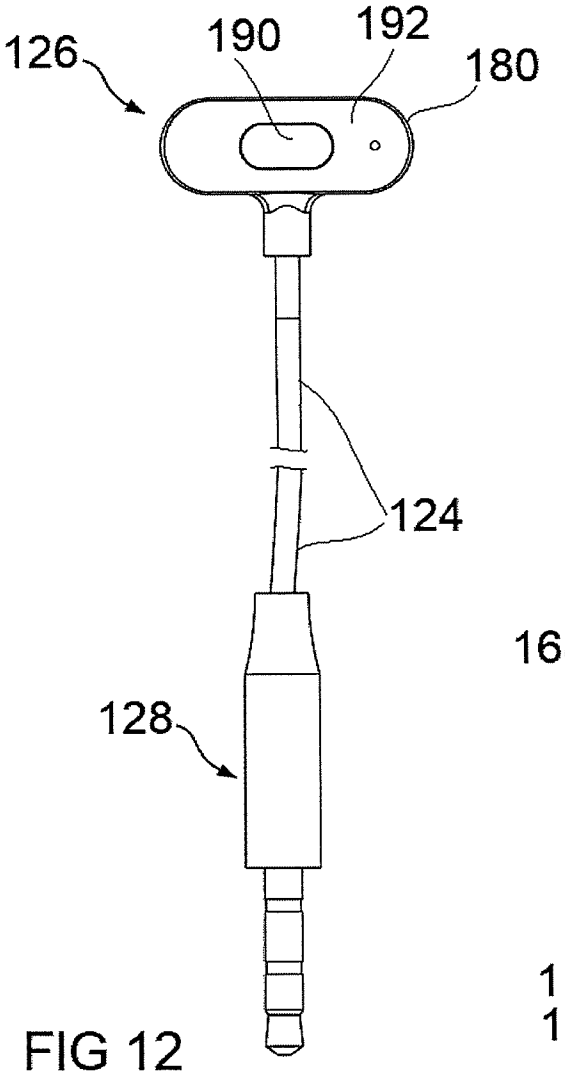
FIG. 12 shows second electrical cabling and fourth and fifth electrical connector elements of the earphone system of FIG. 9.

Referring to FIGS. 12 and 13, the earphone system 110 further comprises second electric cabling 124 having a first end provided with a fourth electrical connector element 126 and a second end provided with a fifth electrical connector element 128.

As best seen in FIG. 13, the fourth electrical connector element 126 comprises a body 180 having a major face that defines a recess 182. The body 180 may be an elongate body that is relatively long in a direction perpendicular to the lengthways direction of the second electric cabling 124 and relatively narrow in directions transverse to its lengthways direction. The recess 182 is configured to receive the boss 174 of the third electrical connector element 122. The fourth electrical connector element 126 is provided with three electrical connector elements in the form of spring-loaded pins 184 projecting from the base of the recess 182 and configured to engage the contact pads 176 when the boss 174 is inserted into the recess 182. The fourth electrical connector element 126 is further provided with two magnetic keeper elements 186 disposed in the base of the recess 182 and configured to be engaged by the magnets 178 when the boss 174 is inserted in the recess 182. The boss 174 and recess 182 are preferably configured to be a complementary sliding fit so that the contact pads 176 and magnets 178 are reliably guided into engagement with the respective pins 184 and magnetic keeper elements 186 when the boss 174 is inserted into the recess 182. The magnets 178 and magnetic keeper elements 186 form a magnetic locking system that holds the third and fourth electrical connector elements 122, 126 together so that a reliable electrical connection may be made between the pads 176 and pins 184. Although not essential, the contact pads 176 may be disposed generally centrally on the boss 174 between the two magnets 178 and similarly, the pins 184 may be disposed generally centrally in the recess 182 and between the two magnetic keeper elements 186.

It is to be understood that the configuration of the third and fourth electrical connector elements 122, 126 described above is not to be taken as limiting and that many variations are possible. For example, the recess 182 may be provided in the third electrical connector element 122 while the complementary raised portion, or boss, 174 may be provided on the fourth electrical connector element 126. Similarly, the electrical connector elements 176 on the third electrical connector element 122 may be spring-loaded pins and the electrical connector elements 184 on the fourth electrical connector element 126 may be contact pads engageable by such pins. Still further, the magnets 178 may be provided on the fourth electrical connector element 126 and the magnetic keeper elements 186 may be provided on the third electrical connector element 122.

In this example, the fifth connector element 128 is a 3.5 mm jack plug, although, this is not to be taken as limiting since the fifth connector element may be any suitable electrical connector element for at least conducting an audio signal from a device connected to the earphone system 110.

In some examples, a switch, or button, 190 may be provided on the fourth electrical connecter element 128. The button 190 may be disposed on the major face 192 of the body 180 that is opposite the recess 182. The button 190 may be connected with the second electric cabling 124 so as to function as an on/off switch operable by a user to accept and end telephone calls made using a telephonic device connected to the earphone system 110 via the fifth electrical connector element 126. Thus, if the earphone system 110 is connected up to a smartphone or the like, a wearer of the earphone system 110 may answer or end telephone calls by simply touching the button 190, rather than having to reach into their pocket or a holder to access telephonic device.

The earphone system 110 can be used in any of the three configurations shown in FIGS. 6 to 8 in analogous fashion to the earphone system 10. As mentioned above, the configuration of the first and second electrical connector elements 118, 120 and the electrical connector elements 164 makes it easy for a user wearing the ear buds 112, 114 to plug the first and second electrical connector elements 118, 120 into the electrical connector elements 164 even though they will not be able to see the connector elements 164. Similarly, the configuration of the third and fourth electrical connector elements 122, 126 makes it easy to connect the first electric cabling 116 to the second electric cabling 124, even when the ear buds 112, 114 and first electric cabling 116 are being worn in the configuration shown in FIG. 7. This is because instead of having to insert the fourth electrical connector element 126 into the third electrical connector element 122 from below, as is the case of the earphone system 10, the fourth electrical connector element 126 can be brought into engagement with the third electrical connector element 122 by a movement towards the wearer's chest with the recess 182 easily visible to the wearer. Thus, the connection is made by relative movement of the third and fourth electrical connector elements 122, 126 in a direction generally transverse, typically approximately perpendicular, to the wearer's chest, as opposed to an upward movement in a direction generally parallel to the wearer's chest.

FIGS. 14 to 17 show a storage case 510 suitable for a four-piece earphone system such as the earphone systems 10, 110 illustrated by FIGS. 1 to 13. The storage case 510 is illustrated in a configuration designed for storing the earphone system 110. For ease of description, features of the storage case 510 will be described with reference to parts of the earphone system 110. However, this is not to be taken as limiting and it should be understood that the principles illustrated can readily be adapted and applied to storage cases for storing other four-piece earphone systems, such as the earphone system 10.

Figure 14:
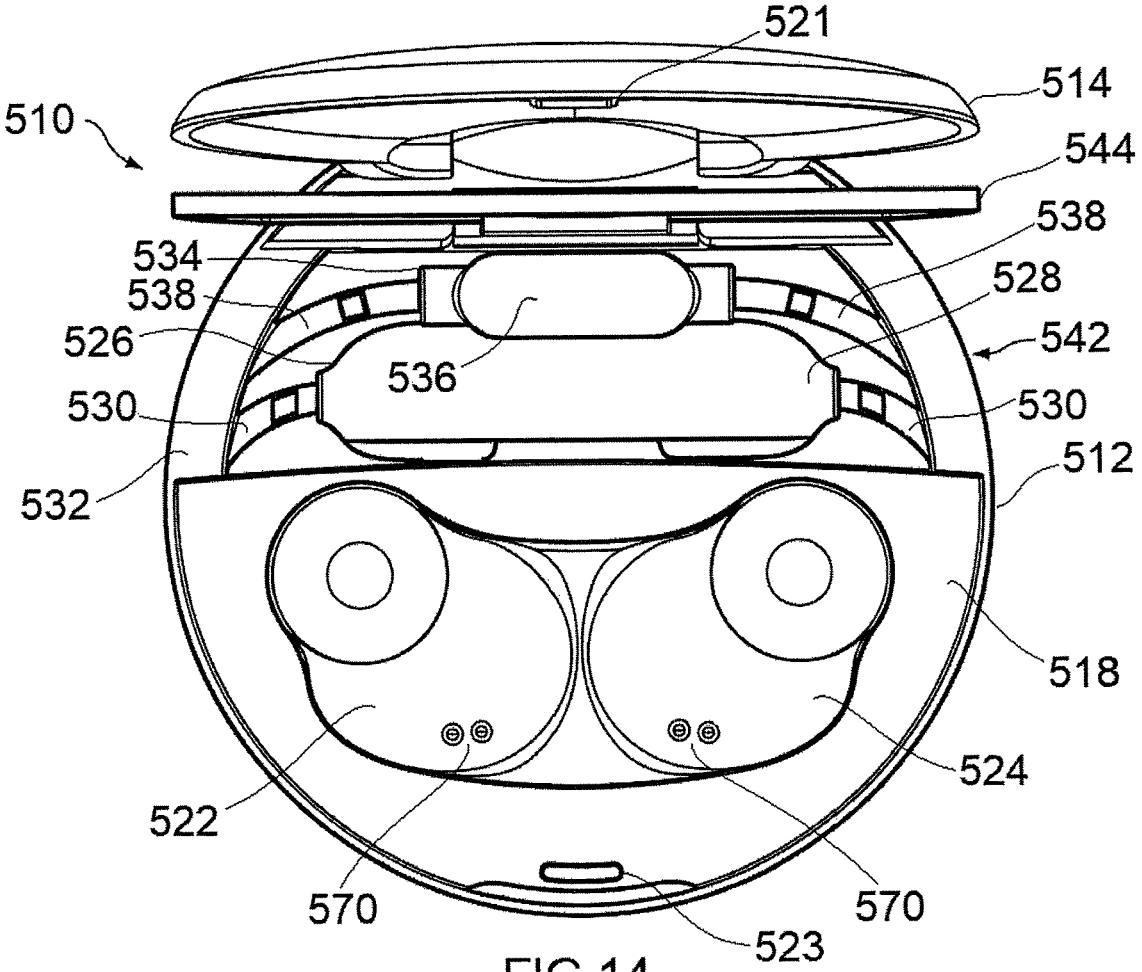
FIG. 14 is a plan view of a storage case for the earphone systems of FIGS. 1 to 13.
Figure 15:
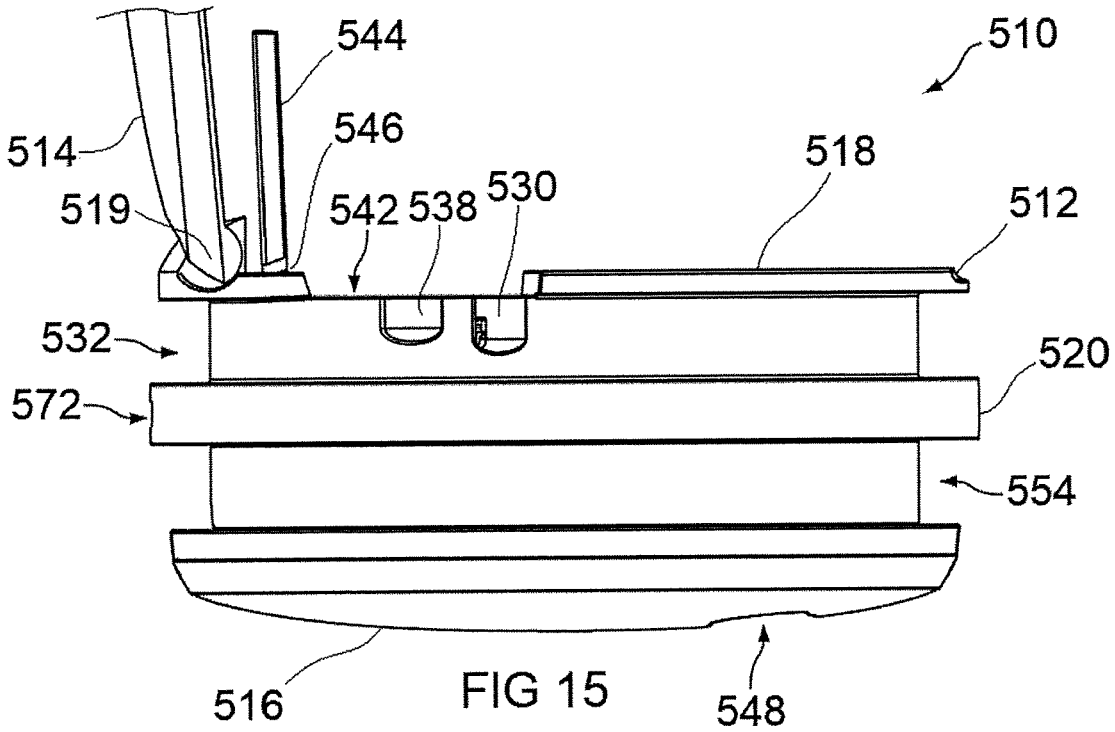
FIG. 15 is a side elevation view of the storage case of FIG. 14.

Referring to FIGS. 14 and 15, although not essential, the storage case 510 comprises a generally circular case body 512 and a generally circular case lid 514. The case body 512 has an underside 516 and a top side 518. The case lid 514 is connected to the rear of the case body 512 by a hinge connection 519. The case body 512 has a circumferentially extending side wall 520 extending between the underside 516 and the top side 518. The case body 512 and case lid 514 may comprise a closure mechanism 521, 523 by which the case lid may be secured to the case body in a closed condition. The closure mechanism may comprise an aperture 523 provided in the top side 518 of the case body 512 and a catch 521 provided on the inner side of the case lid 514 and engageable in the aperture 523.

Figure 20:
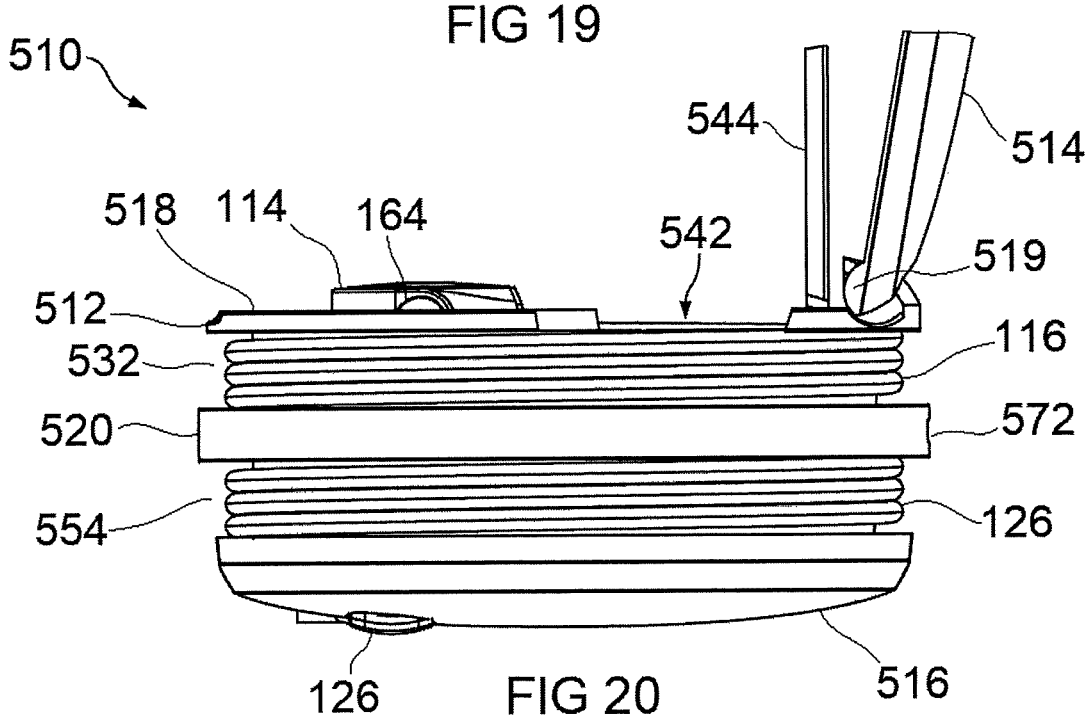
FIG. 20 is a side elevation view of the storage case of FIG. 14 showing elements of an earphone system stored in the storage case.
Figure 21:
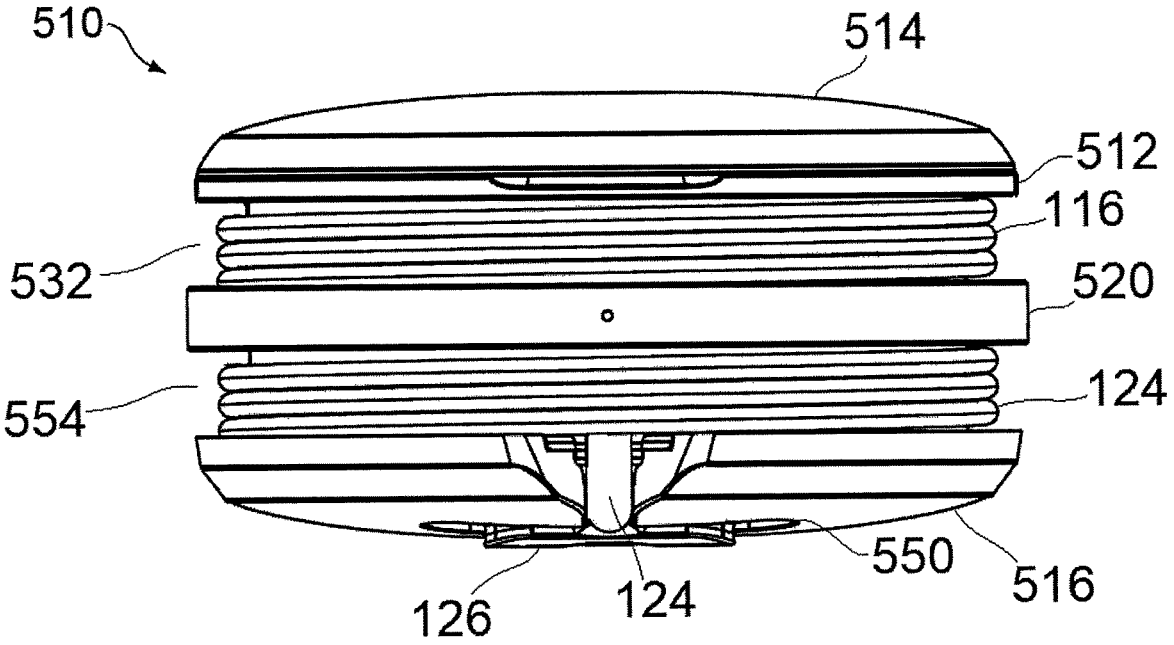
FIG. 21 is a front elevation view showing element of the earphone system stored in the storage case.
Figure 22:
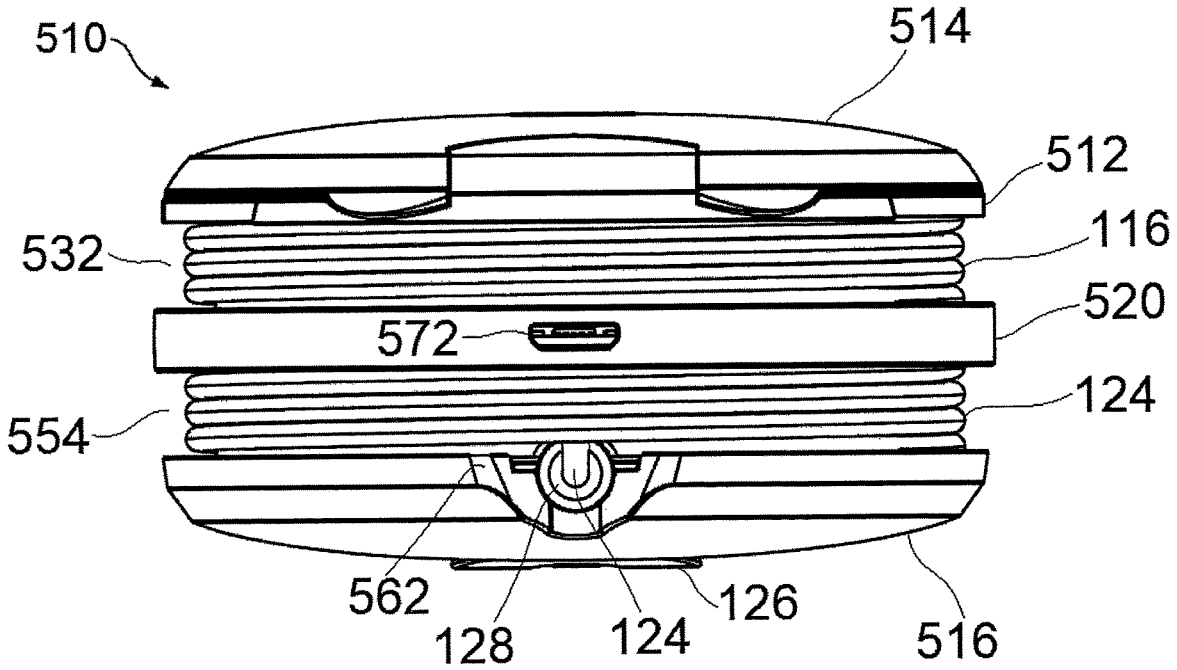
FIG. 22 is a rear elevation view showing elements of the earphone system stored in the storage case.

Still referring to FIGS. 14 and 15, the top side 518 is provided with first recessing 522, 524 configured to receive the first and second ear buds 112, 114. In the illustrated example, the first recessing 522, 524 comprises a major recess that is configured to define respective sub-recesses that separately receive respective ear buds 112, 114. In other examples, the first recessing may be configured as respective discrete recesses configured to receive the first and second ear buds 112, 114. The first recessing 522, 524 may be configured to receive the first and second ear buds 112, 114 with the soft cap 162 inserted first to be received at the bottom of the first recessing and the respective outer end faces 168 visible at the top of the first recessing. The first recessing 522, 524 is configured to provide clearance around the first and second ear buds 112, 114, at least at the open end of the first recessing to facilitate gripping of the ear buds 112, 114 by a user wishing to remove them from the storage case 510. As illustrated by FIG. 20, the configuration of the first recessing 522, 524 may be such that the first and second ear buds 112, 114 project a relatively small distance from the first recessing. This is again to facilitate user access for removing the ear buds 112, 114 from the first recessing 522, 524. In the illustrated example, the first recessing 522, 524 is disposed at the front of the case body 512 and spaced apart from and generally opposite the hinge connection 519.

The top side 518 is further provided with second recessing 526 to receive the first and second electrical connector elements 118, 120. In the illustrated example, the second recessing 526 comprises a relatively large central recess 528 configured to receive the two electrical connectors 118, 120 and respective cable access recesses 530 extending from opposite ends of the central recess 528 to a first cable track 532. It will be understood that it is not essential that the second recessing comprises one relatively large central recess to receive the first and second electrical connector elements 118, 120. Instead there may be central recessing defining respective separate recesses for the first and second electrical connector elements 118, 120. For example, a dividing wall may be provided in the central recess 528 to provide central recessing defining separate recesses to receive the first and second electrical connector elements 118, 120.

Figure 17:
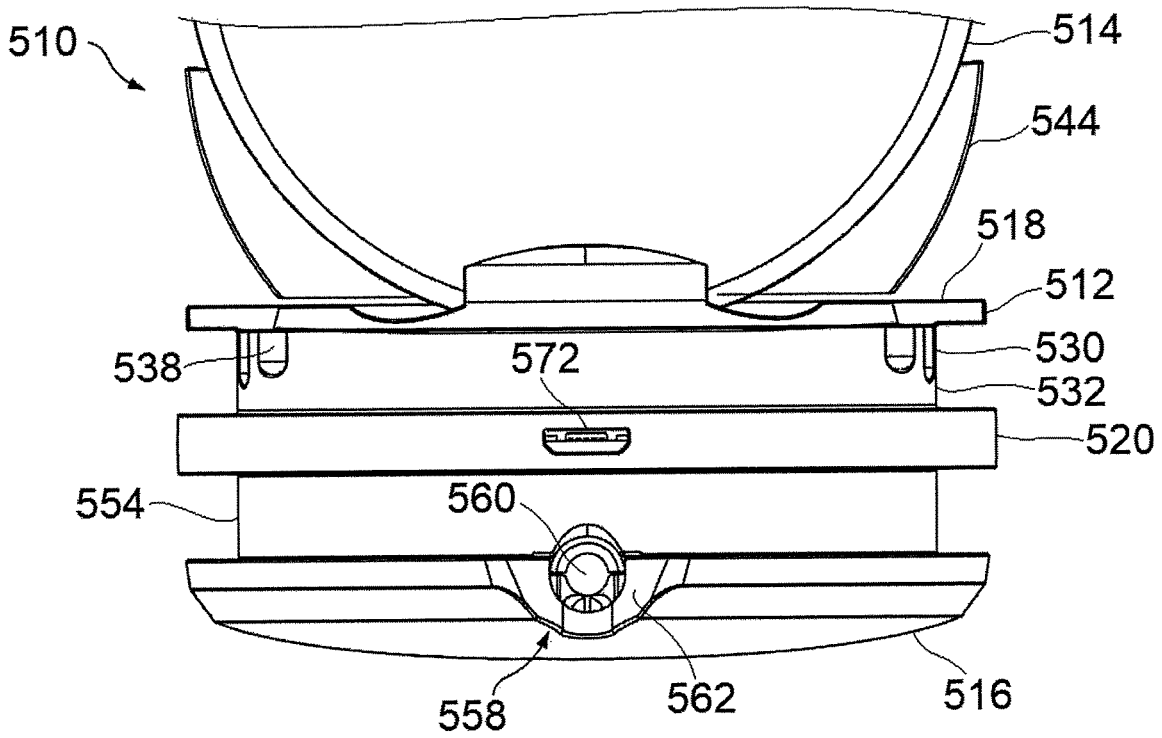
FIG. 17 is a rear elevation view of the storage case of FIG. 14.

The cable access recesses 530 and first cable track 532 are configured to receive the first electric cabling 116. As best seen in FIGS. 15 and 17, the first cable track 532 may be a groove provided in the side wall 520. The first cable track 532 may extend around the entire circumference of the case body 512. The first cable track 532 has a generally has a generally flat upstanding back wall that may be disposed generally parallel to the axis of the case body 512 and generally flat top and bottom walls extending transversely from the back wall, typically perpendicular to the back wall. In other examples, the first cable track may be defined by an arcuate back wall giving it a generally C-shaped cross section.

The top side 518 is further provided with third recessing 534 to receive the third electrical connector element 122. The third recessing 534 may comprise a central recess 536 to receive the third electrical connector element 122 and respective cable access recesses 538 disposed at opposite ends of the central recess 536 and extending from the central recess 536 to the first cable track 532. In this example, the second recessing 526 is disposed intermediate the first recessing 522, 524 and the third recessing 534 and the third recessing is disposed at the back of the case body 512 adjacent the hinge connection 519 to the lid 514. However, this is not essential and in other examples, the third recessing 534 may be disposed intermediate the first recessing 522, 524 and second recessing 526 with the second recessing disposed at the back of the case body 512 adjacent the hinge connection 519. The cable access recesses 530, 538 curve in their lengthways direction so that in transitioning from the first cable track 532 to the second and third recessing 526, 534 the first electric cabling 116 follows a relatively smooth curved path and does not have to turn any sharp corners. The respective pairs of cable access recesses 530, 538 at each side of the case body 512 may be grooves that curve continuously along their length and are disposed in side-by-side spaced apart relationship. It is to be understood that the cable access recesses 530, 538 are not essential as the respective central recesses 528, 536 may be configured to extend to the first cable track 532. However, having cable access recesses 530, 538 provides advantages in terms of tidier storage of the cable and providing a guide for the user when storing the first electric cabling 116 in the storage case 510.

For retention purposes, the cable access recesses 530, 538 may be sized to be a slight interference fit with the first electric cabling 116. Alternatively, the cable access recesses 530, 538 may be a clearance fit and one or more formations may be provided in the recesses to define one or more pinch points to grip the first electric cabling 116. Similarly, one or both of the central recesses 528, 536 may be configured to receive the respective electrical connector elements 118, 120, 122 as a snap-fit, for example, by providing one or more narrowing formations that may deform or deflect when the electrical connectors elements are inserted into the central recesses. In other examples, magnetic keeper elements may be provided in the central recess 536 to cooperate with the magnets 178 to provide for retention of the third electrical connector element 122 by magnetic attraction. In examples making use of the magnets 178 to retain the third electrical connector element 122 in the central recess 536, an inner recess similar to the recess 182 of the fourth electrical connector element 126 may be provided in the base of the central recess 536 to accurately locate the third electrical connector element in the central recess.

Referring to FIGS. 14 and 15, although not essential, a relatively shallow inner lid recess 542 may defined in the top side 518 of the case body 512 between the first recessing 522, 524 and the hinge connection 519. Thus, as best seen in FIG. 14, the second and third recessing 526, 534 extends into case body 512 from the base of the lid recess 542. The storage case 510 may be provided with an inner lid 544 configured to fill the lid recess 542. The inner lid 544 is connected to the case body 512 by a hinge connection 546 (FIG. 15) that may be disposed at the rear of the case body 512 intermediate the hinge connection 519 and the third recessing 534. Alternatively, the inner lid 544 may be connected to the case body 512 on the opposite side of the inner lid recess 542 adjacent the first recessing 522, 524. The inner lid 544 when closed covers the second and third recessing 526, 534, but not the first recessing 522, 524. Although not essential and not shown in the drawings, the inner lid may be provided with a closure mechanism in analogous fashion to the case lid 514.

Figure 16:
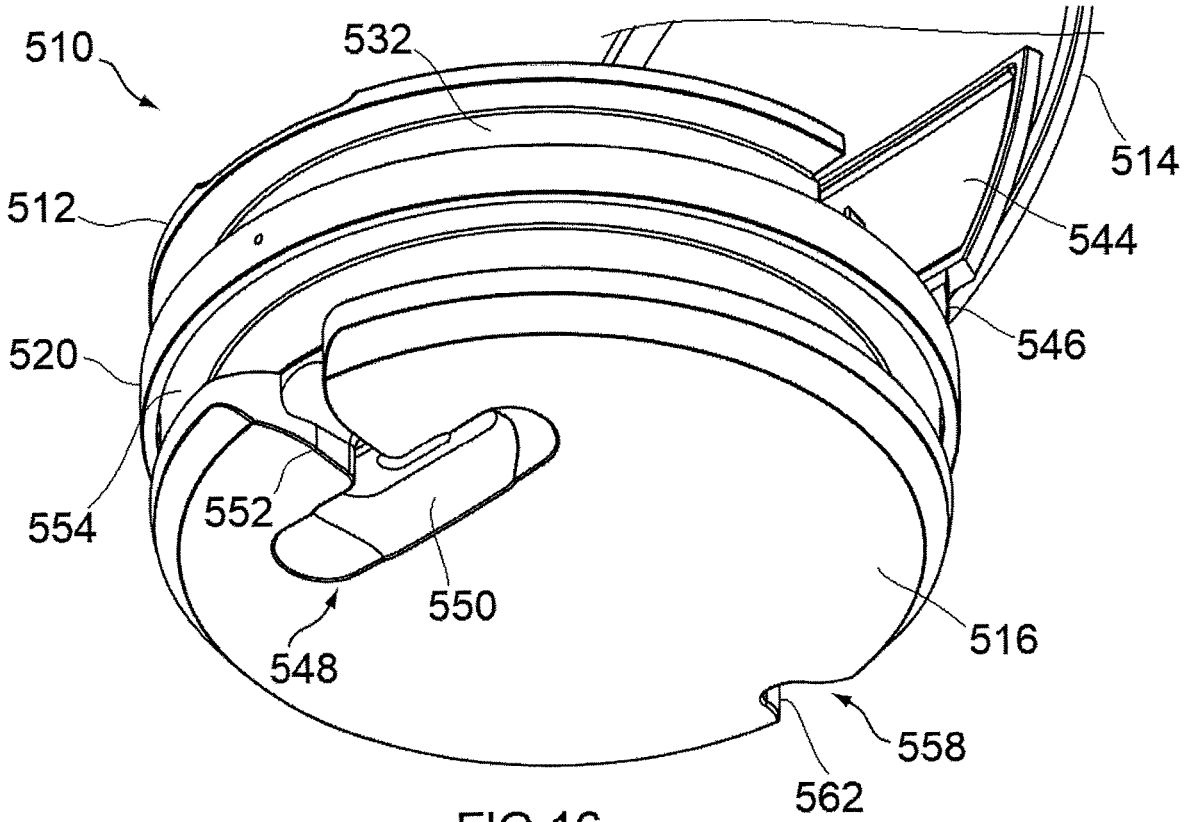
FIG. 16 is a perspective view from below and one side of the storage case of FIG. 14.

Referring to FIGS. 15 and 16, the case body 512 is provided with fourth recessing 548 disposed in the underside 516 of the case body. As best seen in FIG. 16, the fourth recessing 548 comprises a recess 550 configured to receive the fourth electrical connector element 126 and a cable access recess 552 extending from the recess 550 to a second cable track 554. The recess 550 may be an elongate slot configured to receive the body 180 of the fourth electrical connector 126. The cable access recess 552 may extend generally perpendicular to the recess 550 to receive the second electrical cabling 124 where it is joined to and enters the body 180. The cable access recess 552 may extend generally radially with respect to the axis of the case body 512.

The cable access recesses 552 may be a clearance fit for the second electric cabling 124 and one or more formations may be provided in the recess to define one or more pinch points to grip the second electric cabling within the recess. In other examples, the cable access recess may be sized to be a slight interference fit with the second electric cabling 124. Similarly, the recess 550 may be configured to receive the respective fourth electrical connector element 126 as a snap-fit, for example, by providing one or more narrowing formations that may deform or deflect when the electrical connector element is inserted into the recess. In other examples, magnets may be provided in the recess 550 to cooperate with the magnetic keeper elements 186 to provide retention by magnetic attraction.

As best seen in FIGS. 15 and 17, the second cable track 554 may be a groove provided in the side wall 520. The second cable track 554 may extend around the entire circumference of the case body 512. The second cable track 554 has a generally flat upstanding back wall that may extend generally parallel to the axis of the case body 512 and generally flat top and bottom walls extending transversely from the back wall, typically perpendicular to the back wall. In other examples, the second cable track 554 may be defined by an arcuate back wall giving it a generally C-shaped cross section.

The first cable track 532 and second cable track 554 may have the same height and depth or have different proportions to provide different storage volumes that accord with the respective lengths of the first and second electric cabling 116, 124. The first cable track 532 is disposed generally adjacent the top side 518 of the case body 512 and the second cable track 554 is disposed below the first cable track generally adjacent the underside 516 of the case body. The first and second cable tracks 532, 554 are spaced apart so that the side wall 520 between the cable tracks has the appearance of an annular projection extending about the case body 512.

Referring to FIG. 17, the storage case 510 is provided with fifth recessing 558 configured to receive the fifth electrical connector 128. The fifth recessing 558 comprises a bore 560 extending into the interior of the case body 512 and an entry cut-out 562 disposed at the upstream end of the bore 560. The entry cut-out 562 extends between the bore 560 and the second cable track 554 at the outer periphery of the case body 512. The entry cut-out 562 is wider than the bore 560 and the fifth electrical connector element 128 and receives the second electric cabling 124 where it attaches to the fifth electrical connector 128. The entry cut-out 562 provides a lead-in to the bore 560 to assist users when inserting the fifth electrical connector into the bore. The bore 560 may be provided with a retention device (not shown) to retain the fifth electric connector element 128 in the bore. In examples in which the fifth electrical connector element 128 is a jack plug style connector, the retention device may be a spring-biased detent element analogous to the retention devices associated with jack plug sockets. Such devices will be familiar to the person skilled in the art and so will not be discussed further herein. Alternatively, the bore 160 may be partially lined with a friction material, such as a rubber or rubber like material to assist in retaining the fifth electrical connector element 128 in the bore. In other examples, a slit or slits extending along the bore 160 may be formed in the wall of a undersized bore so that the wall may be resiliently deformed as the fifth electrical connector element 128 is inserted into the bore generating a return force stored in the deformed wall sections that acts to retain the fifth electrical connector element in the bore.

Figure 18:
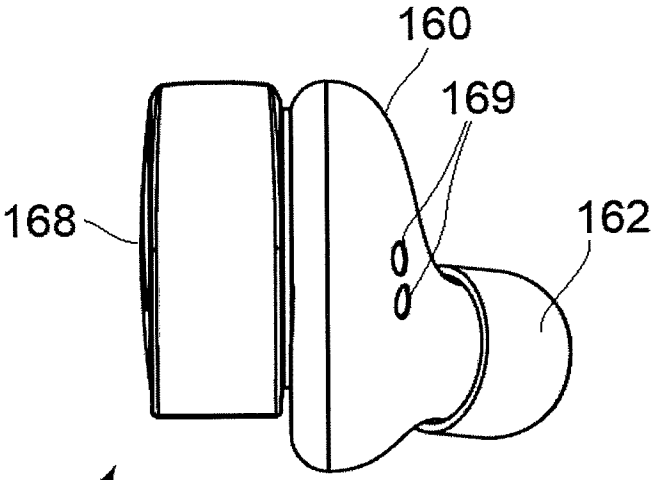
FIG. 18 shows a modified ear bud for the earphone system of FIGS. 9 to 13.

Although not essential, in some examples the storage case 510 may be configured as a charging station for modified ear buds 112, 114. This may be advantageous for use with earphones systems whose cabling and electrical connector elements are not configured for conducting electrical power to the ear buds. Referring to FIG. 18, a modified ear bud 112, 114 corresponds to the ear buds 112, 114 illustrated by FIGS. 9 to 13, except that each is provided with a pair of charging sockets 169. In the illustrated example, the charging sockets 169 are disposed in the ear bud body 160 spaced apart from the respective electrical connector elements 164. As shown in FIG. 14, the first recessing 522, 524 is provided with respective pairs of charging pins 570. The charging sockets 169 and charging pins 570 are configured such that when the ear buds 112, 114 are inserted into the first recessing 522, 524, the charging pins 570 enter and engage in the charging sockets 169 without significant manipulation by the user; that is the ear buds 112, 114 well tend to be guided into the first recessing 522, 524 such that the charging sockets 169 are guided onto the charging pins 570.

As shown in FIG. 17, the storage case 510 is provided with a charging electrical connector element 572. In the illustrated example, the charging electrical connector element 572 is a micro USB socket. In other examples, the charging electrical connector element 572 may be a different form of socket selected to cooperate with the type of plug provided on the charging cable that is intended to be used with the storage case 510. Wiring may be provided in the case body 512 to connect the charging electrical connector element 572 with the charging pins 570. Typically, the storage case 510 will be supplied with a charging cable that has a plug incorporating a transformer that provides an electrical supply conditioned to match the requirements of the ear buds 112, 114 so that there is no need to provide conditioning circuitry in the case body 512. The storage case 510 may be provided with a battery compartment disposed in the case body 512. The battery may be closed into the case body 512 and connected into the charging circuitry so that is recharged when the electrical connector element 572 is connected with a mains electricity supply and power is drawn from it to recharge the ear bud batteries when the electrical connector element 572 is not connected to a mains electricity supply. The charging circuit may operate in analogous fashion to other portable devices that are configured to be powered by an internal battery and by connection to a mains electricity supply, such as laptop computers. Since such charging circuitry will be familiar to those skilled in the art, it will not be further discussed herein. The base body 512 may be provided with an indicator light that is connected with the charging circuit such that it lights up when the storage case 510 is receiving an electrical supply via the charging electrical connector element 572.

Figure 19:
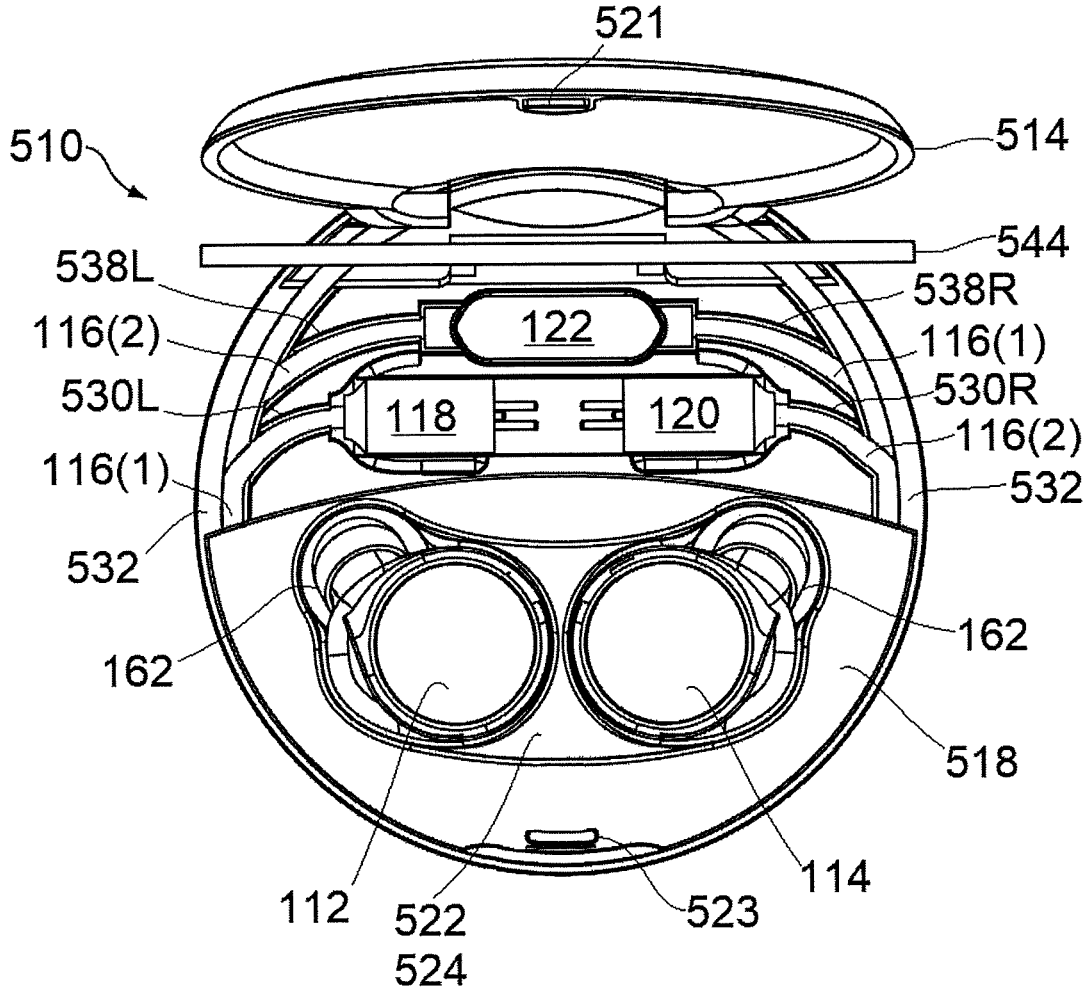
FIG. 19 is a view corresponding to FIG. 14 showing elements of an earphone system stored in the storage case.

Referring to FIGS. 19 and 20, when the earphone system 110 is not in use, the ear buds 112, 114 can be stored in the first recessing 552, 554. To do this, the user simply orientates the ear buds 112, 114 correctly and inserts them into the respective positions, or sub-recesses, in the first recessing 522, 524. If the storage case 510 is configured as a charging storage case, the charging pins 570 will engage in the respective pairs of charging sockets 169 in the ear bud bodies 160 as the ear buds 112, 114 are pushed to their fully inserted positions in the first recessing 522, 524. If the user wishes to charge the ear buds 112, 114, this can then be accomplished by inserting the plug of a suitable charging lead into the charging electrical connector element 572. It will be understood that the charging function only requires the insertion of the ear buds 112, 114 into the first recessing 522, 524 and that it is not necessary to load any of the first and second electric cabling 116, 124 or the associated electrical connector elements into the case body 512. Furthermore, it is not necessary for the inner lid 544 or the case lid 514 to be closed.

Referring to FIGS. 19 to 22, the second electric cabling 124 can be stored in the storage case 510 by inserting the fifth electrical connector element 128 into the bore 160 via the entry cut-out 562. The second electric cabling 124 may then be progressively fed into the second cable track 554 by winding it around the case body 512 until just the fourth electrical connector element 126 and a relatively small length of the second electric cabling 124 is disposed outside of the second cable track 554 within range of, or adjacent, the fourth recessing 548. The remainder of the second electric cabling 124 may then be fed into the cable access recess 552 and the fourth electric connector element 126 pressed into the recess 550.

Referring to FIGS. 19 to 22, to store the first electric cabling 116 and its associated electrical connector elements 118, 120, 122 in the storage case 510, the third electrical connector element 122 may first be pressed into the central recess 536 of the third recessing 534 and the electric cabling 116 directly attached to either side of the third electrical connector element may be then be pressed into the respective cable access recesses 538. The user may then select one of the first and second electrical connector elements 118, 120 and wind the portion of the first electric cabling 116 attached between the selected electrical connector element 118, 120 and the third electrical connector element 122 into the first cable track 532 until the selected electrical connector element and just a relatively short length of attached first electric cabling are disposed outside of the first cable track. Referring to FIG. 19, if the user first selects the first electrical connector element 118, the portion 116(1) of the first electric cabling 116 extending between the third electrical connector element 126 and the first electrical connector element 118 extends through the cable access recess 538R to the right of the central recess 536 and once it has been wound around the first cable track 532, the first electrical connector element 118 will be adjacent the cable access recess 530L to the left of the central recess 528. The remainder of the portion 116(1) of the first electric cabling 116 can then be inserted into the cable access recess 530L and the first electrical connector element 118 inserted into the central recess 528 with its pins 163L, 163S pointing towards the middle of the central recess 528. The portion 116(2) of the first electrical cabling 116 extending between the second electrical connector element 120 and the third electrical connector element 122 extends through the left-hand cable access recess 538L and can be wound around the first cable track 523 in the opposite direction to the portion 116(1) and then into the right-hand cable access recess 530R and the second electrical connector element 120 then inserted into the empty space in the central recess 528 with its pins 163L, 163S pointing towards both the middle of the central recess 528 and the first electrical connector element 118. It will be understood that the above-described order of loading is not essential and that instead, the user may choose to locate the second electrical connector element 120 in the storage case 510 ahead of the first electrical connector element 118.

The inner lid 544 may then be pivoted towards the case body 512 until it sits in and closes the lid recess 542, thus covering the first, second and third electrical connector elements 118, 120, 122 and the adjacent attached portions of the first electric cabling 116 that are housed in the cable access recesses 530, 538. This provides a neat appearance and may function to retain, or assist in retaining, the covered elements in the case body 512. The case lid 514 may then be closed to cover the top side 518 of the case body 512 to complete the closure of the storage case 510. The earphone system 110 can then be easily transported with no danger of losing any of its four separate components or pieces.

If a user wishes to use the earphone system 510, its components can be accessed by reversing the processes described above. If the user merely wishes to use the ear buds 112, 114 in the wireless configuration shown in FIG. 6, it is not necessary to raise the inner lid 544 and it is only necessary to remove the ear buds from the first recessing 522, 524. If the user wishes to use the earphone system 110 in the wireless configuration shown in FIG. 7, the second electric cabling 124 and the associated electrical connector elements 126, 128 remain stored in the storage case 510. If the user wishes to use the earphone system 110 in the configuration shown in FIG. 8, the second electric cabling 124 and associated electrical connector elements 126, 128 are also removed from the storage case 510. It will be understood that when all components of the earphone system 110 are housed in the storage case 510 and the user intends using the earphone system in the hard-wired configuration of FIG. 8, it does not matter in which order the first and second electric cabling and their associated electrical connector elements and the ear buds are removed from the storage case.

When the components of the earphone system 110 are stored in the storage case 510, the portions of the first and electric cabling 116, 124 in the first and second cable tracks 532, 534 are visible and accessible. While not essential and currently not preferred, in some examples, the storage case 510 may be modified to include a covering for the first and second cable tracks 532, 554. For example, a sleeve may be provided that can be slid over the cable tracks 532, 554 once the first and second electric cabling 116, 124 is housed in the cable tracks. The sleeve may be separate from and removable from the case body or attached and, for example, be slideable up and down the side 520 of the case. Alternatively, flaps hinge connected to the case body 512 adjacent at least one of the underside 516 and top side 518 may be provided.

In the illustrated example, the storage case is circular in cross-section. However, this is not to be taken as limiting. Although it is desirable to avoid the presence of sharp corners in the paths followed by the first and second electric cables so that a polygonal case shape is not preferred, elliptical and other curved profile cases may be used. It will also be understood that if a polygonal case shape is desired the cable tracks may still be configured as curved tracks extending about the case body.

It will be understood that the storage case provides separate storage for the four pieces of a four-piece earphone system such as the earphone system 110. The four pieces are storable in readily identifiable and separate storage receptacles, making correct usage straightforward for the user. Furthermore, the four pieces can be accessed separately as required, so that the user can readily avoid accessing pieces that are not required when earphone system is being used in either of the configurations illustrated by FIGS. 6 and 7. Furthermore, the storage case may also be configured to serve as a charging stand by providing suitable electrical components in the case body and electrical connector elements that are connectable with electrical connector elements of the ear buds.

The storage case may be configured to provide receptacles for the electrical connectors associated with the first electric cabling in or adjacent the top side of the case body and receptacles for the electrical connectors associated with the second electric cabling located in or adjacent the underside of the case body so that the respective sets of receptacles are spaced apart at opposite ends of the case body. The receptacles take the form of recessing defined by the case body and are connected by respective cable tracks for the electric cabling.

The storage case may comprise a case lid that covers at least some of the receptacles provided for the components of the earphone system. For example, the case lid may cover the ear buds and the electrical connector elements received in the recessing provided in the top side of the case body. Although the case lid of the illustrated example is hinge connected to the case body, in some examples, the case lid may be slidable on the case body or completely removable from the case body. The storage case may also be provided with one or more inner lids configured to cover a sub-set of the parts covered by the case lid. For example, as illustrated, an inner lid may cover the electrical connector elements housed in recessing provided in the top side of the case body, but not the ear buds so that the ear buds remain accessible, even when the inner lid is in a closed condition.

The storage case may be made of any suitable material. Many examples will comprise a plurality of plastics moldings. The case body may for example comprise two plastics moldings joined in face-to-face relationship once any internal components, such as electrical connectors, a battery or batteries and charging circuitry have been assembled inside one or both moldings.

It is to be understood that the numbering of the electrical connector elements and recessing as first, second, third etc.

is purely for ease of identification for descriptive purposes and is not to be taken as limiting in any sense.

Thus, although there have been described particular embodiments of the present invention of a new and useful Earphone Systems it is not intended that such references be construed as limitations upon the scope of this invention except as set forth in the following claims.

What is claimed is:

1. An earphone system comprising:

a first ear bud having wireless communications circuitry and an electrical connector element;

a second ear bud having wireless communications circuitry and an electrical connector element;

a first electric cabling having a first end provided with a first electrical connector element releasably connectable with said electrical connector element of said first ear bud, a second end provided with a second electrical connector element releasably connectable with said electrical connector element of said second ear bud and a third electrical connector element disposed intermediate said first and second ends of the first electric cabling; and second electric cabling having a first end provided with a fourth electrical connector element releasably connectable with said third electrical connector element and a second end provided with a fifth electrical connector element connectable with an output connector element of an electronic device to receive an audio signal from said electronic device, wherein the third electrical connector element and the fourth electrical connector element comprise a plurality of spring-loaded electrical connector elements and respective electrical contact pads engageable by the spring-loaded electrical connector elements when the third and fourth electrical connector elements are connected, wherein said third and fourth electrical connector elements are provided with a magnetic securing system to provide secured engagement between said spring-loaded electrical connector elements and said electrical contact pads, and wherein said first and second earbuds are operable in each of the following configurations in which:

i) said first and second earbuds are not connected to said first and second electric cabling; or ii) said first and second earbuds are connected by said first electric cabling but not connected to said second electric cabling; or iii) said first and second earbuds are connected by said first electric cabling and said first electric cabling is electrically connected to said second electric cabling via said third and fourth electrical connectors.

2. The earphone system claimed in claim 1, wherein said wireless communications circuitry is configured to operate a Bluetooth protocol.

3. The earphone system claimed in claim 1, wherein:

said first electrical connector element comprises a male electrical connector element and said electrical connector element of said first ear bud comprises a female electrical connector element configured to receive said first electrical connector element; and said second electrical connector element comprises a male electrical connector element and said electrical connector element of said second ear bud comprises a female electrical connector element configured to receive said second electrical connector element.

4. The earphone system claimed in claim 3, wherein said first and second electrical connector element are USB plugs.

5. The earphone system claimed in claim 3, wherein said first and second connector elements each comprise a first number (n) of male electrical connector elements and said electrical connector elements of said first and second ear buds each comprise a second number (n+10 of female electrical connector elements that is one greater than the first number (n) and said male and female electrical connectors are configured such that said first and second electrical connector elements can be connected to said connector elements of said first and second ear buds in two different orientations.

6. The earphone system claimed in claim 5, wherein said male electrical connector elements comprise first and second male connector elements that each have a first length and a first width and a third male connector element that has a second length and a second width and at least one of:

i) the second length is different to the first length; and ii) the second width is different to the first width.

7. The earphone system claimed in claim 1, wherein said third and fourth electrical connector elements define a boss and a recess configured such that said boss is received in said recess when said third and fourth electrical connector elements are connected to guide said spring-loaded electrical connector elements and electrical contact pads into said engagement.

8. The earphone system claimed in claim 1, wherein said fifth electrical connector element is a USB plug, Lightning® plug or a jack plug.

9. The earphone system claimed in claim 1, comprising at least two said second electric cablings, wherein the fifth electrical connector element of a first of said second electric cablings is a USB plug and the fifth electrical connector element of a second of said second electric cablings is a jack plug or a Lightning® plug.

10. The earphone system claimed in claim 1, wherein said first and second ear buds comprise respective rechargeable batteries and further comprising a contactless charger for electrically charging said rechargeable batteries.

11. An electronic system comprising:

an earphone system comprising:

a first ear bud having wireless communications circuitry and an electrical connector element;

a second ear bud having wireless communications circuitry and an electrical connector element;

a first electric cabling having a first end provided with a first electrical connector element releasably connectable with said electrical connector element of said first ear bud, a second end provided with a second electrical connector element releasably connectable with said electrical connector element of said second ear bud and a third electrical connector element disposed intermediate said first and second ends of the first electric cabling; and second electric cabling having a first end provided with a fourth electrical connector element releasably connectable with said third electrical connector element and a second end provided with a fifth electrical connector element connectable with an output connector element of an electronic device to receive an audio signal from said electronic device, and a said electronic device, wherein the third electrical connector element and the fourth electrical connector element comprise a plurality of spring-loaded electrical connector elements and respective electrical contact pads engageable by the spring-loaded electrical connector elements when the third and fourth electrical connector elements are connected, wherein said third and fourth electrical connector elements are provided with a magnetic securing system to provide secured engagement between said spring-loaded electrical connector elements and said electrical contact pads, wherein said electronic device comprises a said output connector element and wireless communications circuitry configured to communicate with the said wireless communications circuitry of at least one of said first and second ear buds and wherein said first and second earbuds are operable in each of the following configurations in which:

i) said first and second earbuds are not connected to said first and second electric cabling; or ii) said first and second earbuds are connected by said first electric cabling but not connected to said second electric cabling; or iii) said first and second earbuds are connected by said first electric cabling and said first electric cabling is electrically connected to said second electric cabling via said third and fourth electrical connectors.

12. The electronic system claimed in claim 11, wherein said electronic device is a portable electronic device.

13. A storage case and earphone system, wherein:

said earphone system comprises:

a first ear bud having wireless communications circuitry and an electrical connector element;

a second ear bud having wireless communications circuitry and an electrical connector element;

a first electric cabling having a first end provided with a first electrical connector element releasably connectable with said electrical connector element of said first ear bud, a second end provided with a second electrical connector element releasably connectable with said electrical connector element of said second ear bud and a third electrical connector element disposed intermediate said first and second ends of the first electric cabling; and second electric cabling having a first end provided with a fourth electrical connector element releasably connectable with said third electrical connector element and a second end provided with a fifth electrical connector element connectable with an output connector element of an electronic device to receive an audio signal from said electronic device; and wherein said storage case comprises a case body having:

first recessing configured to receive said first and second ear buds;

a first cable track extending about said case to receive first electric cabling;

third recessing configured to receive said third electrical connector element;

fourth recessing configured to receive said fourth electrical connector element;

fifth recessing configured to receive said fifth electrical connector element;

a second cable track extending about said case to receive second electric cabling; and a case lid to cover said top side and an inner lid to cover an inner lid recess defined in said top side and wherein at least one of said second and third recessing extends into said case body from said inner lid recess, and wherein said case body comprises a top side, an underside and a side wall extending between said top side and said underside, said first and second cable tracks extend about said side wall and said first cable track is disposed closer to said top side than to said underside and said second cable track is disposed closer to said underside than said top side.

14. The storage case and earphone system claimed in claim 13, wherein:

said second recessing comprises central recessing to receive said first and second electrical connector elements, a first cable access recess extending from a first end of said central recessing to said first cable track and a second cable access recess extending from a second end of said central recessing to said first cable track, said first end being opposite said second end; and said third recessing comprises a central recess to receive said third electrical connector elements a first cable access recess extending from a first end of said central recess to said first cable track and a second cable access recess extending from a second end of said central recess to said first cable track, said first end being opposite said second end.

15. The storage case and earphone system claimed in claim 14, wherein each of said first and second cable access recesses comprises a groove having a length and each said groove curves along said length.

16. The storage case and earphone system as claimed in claim 13, wherein said first and second ear buds are each provided with charging electrical connectors and said first recessing is provided with respective charging electrical connectors releasably engageable by said charging electrical connectors of said first and second ear buds when said first and second ear buds are inserted into said first recessing.

17. The storage case and earphone system claimed in claim 16, wherein said case body is provided with a battery housing compartment and said charging electrical connectors of said first recessing are connected with electrical connectors in said battery housing compartment to, in use, receive electrical power from a battery housed in said battery housing compartment.

18. The storage case and earphone system as claimed in claim 16, wherein said case body is provided with charging electrical connector element configured to releasably connect to a mains electric power lead.

* * * * *